US011078678B2

(12) United States Patent
Eilers et al.

(10) Patent No.: US 11,078,678 B2
(45) Date of Patent: Aug. 3, 2021

(54) ERECTABLE SHED AND THE PACKAGING THEREOF

(71) Applicant: ShelterLogic Corp., Watertown, CT (US)

(72) Inventors: Mark Alan Eilers, St. Jacob, IL (US); Duane J. Niemeyer, Aviston, IL (US); Robert Joseph Kinsella, O'Fallon, IL (US); Michael Allen Spicer, Trenton, IL (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 16/555,167

(22) Filed: Aug. 29, 2019

(65) Prior Publication Data

US 2020/0071947 A1 Mar. 5, 2020

Related U.S. Application Data

(60) Provisional application No. 62/725,291, filed on Aug. 31, 2018.

(51) Int. Cl.
*E04H 1/12* (2006.01)
*E04B 1/24* (2006.01)

(52) U.S. Cl.
CPC ..... *E04H 1/1205* (2013.01); *E04B 1/2403* (2013.01); *E04B 2001/246* (2013.01); *E04B 2001/2472* (2013.01); *E04B 2001/2481* (2013.01); *E04B 2103/06* (2013.01)

(58) Field of Classification Search
CPC ..... E04H 1/1205; E04B 1/2403; E04B 2001/246; E04B 2001/2481; E04B 2001/2472; E04B 2103/06
See application file for complete search history.

(56) References Cited

U.S. PATENT DOCUMENTS

| | | | |
|---|---|---|---|
| 3,987,597 | A | 10/1976 | Smrt |
| 5,657,583 | A | 8/1997 | Tennant |
| 5,718,089 | A | 2/1998 | Dakin |
| 5,881,789 | A | 3/1999 | Melashenko et al. |
| 6,250,022 | B1 | 6/2001 | Paz et al. |
| 6,543,197 | B2 | 4/2003 | Wetzel, III et al. |
| 6,581,337 | B1 | 6/2003 | Skov et al. |
| 7,296,584 | B2 | 11/2007 | Goldwitz |
| 7,509,776 | B2 | 3/2009 | Reisman |
| 7,779,579 | B2 | 8/2010 | Mower et al. |

(Continued)

OTHER PUBLICATIONS

Search Report and Written Opinion for PCT/US2019/048781 (8 pages). (Year: dated 2019).*

*Primary Examiner* — Rodney Mintz
(74) *Attorney, Agent, or Firm* — Carmody Torrance Sandak & Hennessey LLP

(57) ABSTRACT

A kit comprising components of an erectable shed, wherein the erectable shed is made of metal, in comprises at least two door panels, each of which is at least thirty four inches in height, wherein the components can be packaged in a box having dimensions of no greater than 48 inches×20 inches×10 inches, and wherein the space perimetered by the wall panels and side panels when the erectable shed is erected is at least 6 feet long by 40 inches wide and wherein the height of the shed when erected is at least 6 feet.

8 Claims, 36 Drawing Sheets

(56) References Cited

U.S. PATENT DOCUMENTS

| | | | | |
|---|---|---|---|---|
| 8,646,220 | B2 * | 2/2014 | Kopp | E04H 1/1205 52/79.1 |
| 10,370,847 | B2 * | 8/2019 | Caffaratti Giro | E04H 1/12 |
| 10,889,984 | B2 * | 1/2021 | Arguin | E04B 1/34326 |
| 2004/0111983 | A1 | 6/2004 | Rozenberg et al. | |
| 2006/0108899 | A1 | 5/2006 | Jin | |
| 2006/0277852 | A1 | 12/2006 | Mower et al. | |
| 2012/0102847 | A1 * | 5/2012 | Kopp | E04H 1/1205 52/79.1 |
| 2012/0110926 | A1 * | 5/2012 | Phillips | E04H 1/1205 52/79.9 |
| 2017/0356182 | A1 | 12/2017 | Caffaratti Giro | |
| 2020/0149273 | A1 * | 5/2020 | Arguin | E04F 13/0894 |
| 2020/0232203 | A1 * | 7/2020 | Weber | E04C 3/06 |
| 2021/0054614 | A1 * | 2/2021 | Benard | E04B 5/023 |

* cited by examiner

ERECTABLE SHED AND THE PACKAGING THEREOF

BACKGROUND OF THE INVENTION

The present invention relates to arrangements and methods for erecting, storing, displaying and/or transporting sheds and/or the components thereof, and more particularly, to a kit comprising components of an erectable shed that when erected, the space perimetered by the wall panels and side panels of the erected shed is at least 6 feet long (L) by 40 inches wide (W) and wherein the height of the erectable shed when erected is at least 6 feet (H), and wherein when the erectable shed is not erected, the components thereof are storable, transportable and/or displayable in a box having dimensions of no greater than 48 inches×20 inches×10 inches.

U.S. Pat. No. 7,296,584 describes a system and method for packaging and transporting canopies that can fit in an automobile trunk.

However, the state of the art is deficient in the recognition and the ability to achieve similar advantages and objectives in connection with sheds, and preferably, but not limited to, metal sheds. Specifically, the state of the art is devoid of any description, teaching or suggestion of being able to assemble, store, transport and/or display a metal shed that is, for example and not limitation, at least 6 feet long by 40 inches in width, with a wall height of at least 6 feet when erected, and in which all of the components thereof can fit and be stored, transported and/or displayed in a box that is no greater than 48 inches×20 inches by 10 inches. It should be recognized however, that the invention is not limited thereby, as those skilled in the art would understand variations thereof are achievable in view of the disclosure herein. For the avoidance of doubt, the terms "erected" and "assembled" and/or "erectable" and "assembleable" may be used interchangeably herein and are intended to have identical meanings.

Thus, it would be desirable to provide an erectable metal shed having dimensions, when erected, of at least 6 feet long by 40 inches wide, with a wall height of at least 6 feet, and when stored, transported and/or displayed (e.g. in a store or the like), can fit, i.e. or more accurately, the components thereof can fit and be packaged, in a box that is no greater than 48 inches×20 inches by 10 inches. Such a box also permits for easy carrying and transport of the erectable shed kit to one's destination (e.g. home) in a passenger vehicle, such as a car. It is thus believed that further advances to the state of the art are both desirable and achievable, all of which are provided by the embodiments disclosed herein.

There is also a need for an improved erectable shed kit and methods for assembling, storing, transporting and/or displaying such erectable sheds and/or the components thereof, which provides for compact storage and transport while still providing for easy assembly and acceptable structural integrity when assembled, all of which are also provided by the embodiments disclosed herein.

SUMMARY AND OBJECTIVES OF THE INVENTION

It is thus an objective of the present invention to overcome the perceived deficiencies in the prior art.

For example, it is an advantage and objective of the present invention to provide arrangements and methods for assembling, storing, transporting and/or displaying sheds, and preferably metal sheds, and/or the components thereof in a smaller container (e.g. box) or packaging than heretofore achieved.

It is a particular advantage and objective of the present invention to provide an erectable and preferably metal shed having dimensions, when erected, of at least 6 feet long×40 inches wide, with a wall height of at least 6 feet, and when stored, transported and/or displayed in an unassembled form, can fit, i.e. or more accurately, the components thereof can fit, in a box that is no greater than 48 inches×20 inches by 10 inches.

It is a further advantage and objective of the present invention to provide a kit of an erectable shed of the erected dimensions disclosed herein and storable and displayable and packaged in a box with the dimensions herein that is also easy assembleable and provides for acceptable structural integrity when assembled.

Other advantages and objectives will be made apparent from the disclosure herein. It should also be appreciated that the present invention can be implemented and utilized in numerous ways.

Further objects and advantages of this invention will become more apparent from a consideration of the drawings and ensuing description.

The invention accordingly comprises the features of construction, combination of elements, methods of operation and arrangement of parts which will be exemplified in the construction, illustration and description hereinafter set forth, and the scope of the invention will be indicated in the claims.

Therefore, to overcome the perceived deficiencies in the prior art and to achieve the objects and advantages set forth above and below, a preferred embodiment of the present invention is, generally speaking, directed to a kit comprising components of an erectable shed, comprising a plurality of wall panels and side panels; a plurality of posts for supporting the wall panels and side panels coupled thereto; a plurality of roof panels, coupleable to the plurality of wall panels and/or the plurality of posts, for providing shelter to a space perimetered by the plurality of wall panels and side panels when coupled together and vertically supported by the plurality of posts; at least two (2) door panels, each of at least 34 inches in height, for providing access to the space perimetered by the plurality of wall panels and side panels when coupled together and vertically supported by the plurality of posts; and wherein when the erectable shed is erected the space perimetered by the wall panels and side panels is at least 6 feet long by 40 inches wide and wherein the height of the erectable shed when erected is at least 6 feet; and wherein when the erectable shed is not erected, the components thereof are storable in a box having dimensions of no greater than 48 inches×20 inches by 10 inches.

Based thereon, in another preferred embodiment, the present invention is directed to a kit comprising components of an erectable shed, wherein the kit comprises a plurality of wall panels and side panels; a plurality of posts for supporting the wall panels and side panels coupled thereto; a plurality of roof panels, coupleable to the plurality of wall panels and/or the plurality of posts, for providing shelter to a space perimetered by the plurality of wall panels and side panels when coupled together and vertically supported by the plurality of posts; at least two (2) door panels, each of which is at least thirty four inches in height, for providing access to the space perimetered by the plurality of wall panels and side panels when coupled together and vertically supported by the plurality of posts; and a box having dimensions of no greater than 48 inches×20 inches×10 inches, wherein said plurality of wall panels and side panels, said plurality of posts, said plurality of roof panels, and said at least two (2) door panels are provided in said box when the erectable shed is not erected; and wherein the space perimetered by the wall panels and side panels when the erectable shed is erected is at least 6 feet long by 40 inches wide and wherein the height of the shed when erected is at least 6 feet.

In yet another preferred embodiment, the present invention is directed to a method of erecting the above mentioned erectable sheds, wherein the method comprises the steps of removing all of the components of the erectable shed from the box; and constructing the erectable shed so as to have a space perimetered by the wall panels and side panels of at least 6 feet long by 40 inches wide and wherein the height of the shed is at least 6 feet.

In a specific preferred embodiment and as illustrated in the Figures, the interior space provided by the erectable sheds of the present invention is at least 72 inches long (L), at least 40 inches wide (W) and at least 72 inches high (H), with an exterior size of at least 78 inches long, at least 45 inches wide and at least 77 inches high. In a specific preferred embodiment, the interior space provided by the erectable sheds of the present invention is at least 72 inches long (L), at least 41 inches wide (W) and at least 76 inches high (H), with a specific preferred exterior size being at least 79 inches long (L), at least 45 inches wide (W) and at least 77 inches high (H). In a specific preferred embodiment, the interior space provided by the erectable sheds of the present invention is 72.34 inches long (L), 41.90 inches wide (W) and 77 inches high (H), with a specific preferred exterior size being 80 inches long (L), 45.69 inches wide (W) and 77.31 inches high (H). The foregoing provides a footprint of about 21 square feet inside the shed and about 126 cubic feet of space inside the shed.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
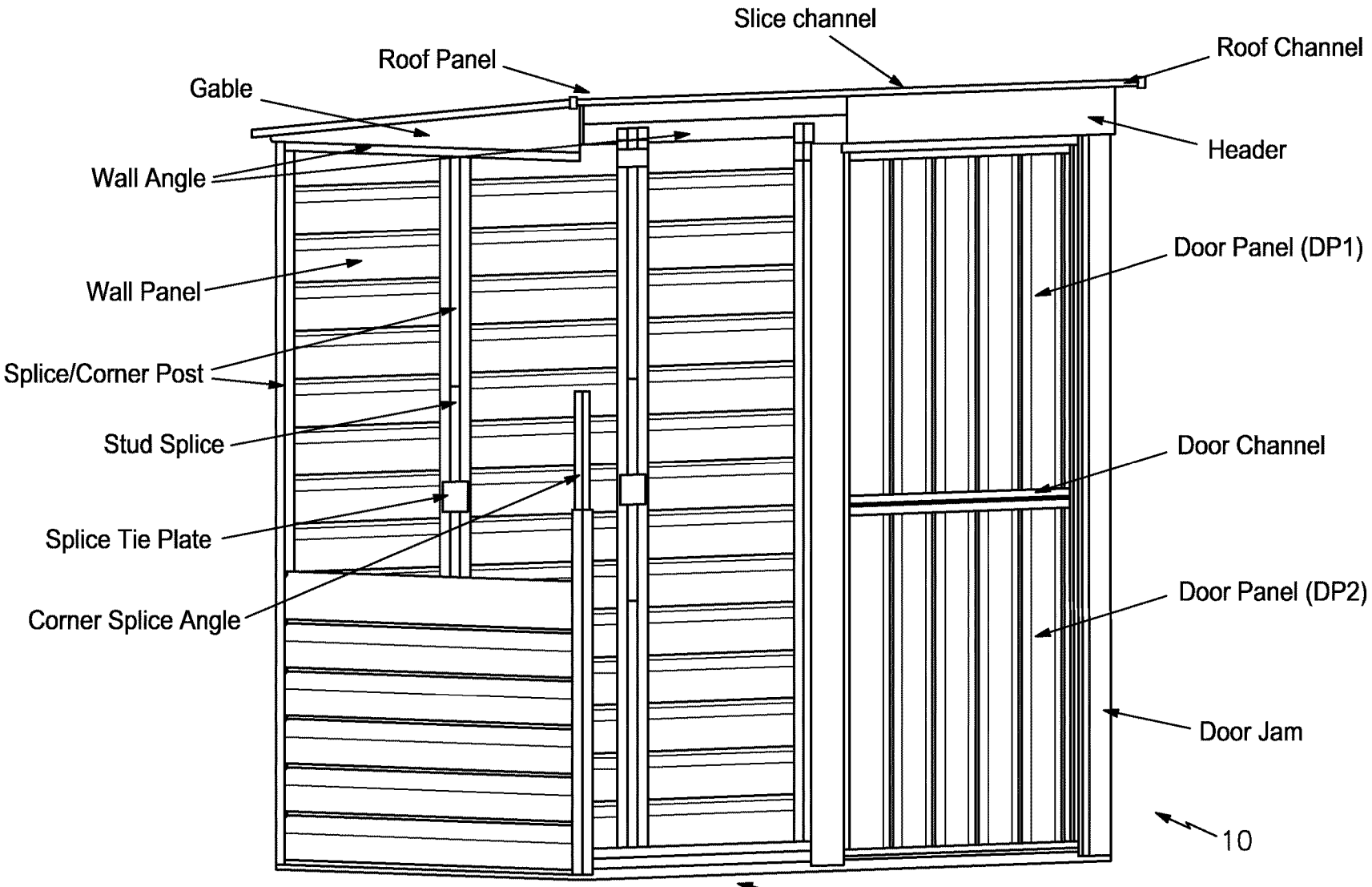
FIG. 1 is a view of an anatomy of a shed of a first embodiment constructed in accordance with the present invention.

Reference will now be made to the figures in connection with an erectable shed, and a kit comprising components of such an erectable shed that when erected, the space perimetered by the wall panels and side panels is at least 6 feet long (L) by 40 inches wide (W) and wherein the height of the erectable shed is at least 6 feet (H) as indicated in the figures, and wherein when the erectable shed is not erected, the components thereof are storable, transportable and/or displayable in a box having dimensions of no greater than 48 inches×20 inches by 10 inches.

It should be understood that the dimensions provided herein are preferred dimensions, but manufacturing and/or other tolerances are anticipated, so small variations in the foregoing are expected. Moreover, while a packaging box of 48" long×20" wide×10" high is preferred for a shed of the foregoing dimensions, the objective of the present invention would be that such a box is could be reduced further, if desired. Therefore, a packaging box of less than 48" inches long×20" wide×10" high is also anticipated to package, store, transport and/or display the foregoing exemplary dimensioned sheds of the present invention.

It should also be noted that in accordance with the present invention, a box having dimensions that are no greater than 48" long×20" wide×10" high can be packaged with components of an erectable shed as disclosed herein that is provided with an interior space that is at least 72 inches long (L), at least 40 inches wide (W) and at least 72 inches high (H), with an exterior size of at least 78 inches long, at least 45 inches wide and at least 77 inches high. In a specific preferred embodiment, the interior space provided by the erectable sheds of the present invention is at least 72 inches long (L), at least 41 inches wide (W) and at least 76 inches high (H), with a specific preferred exterior size being at least 79 inches long (L), at least 45 inches wide (W) and at least 77 inches high (H). In a specific preferred embodiment, the interior space provided by the erectable sheds of the present invention is 72.34 inches long (L), 41.90 inches wide (W) and 77 inches high (H), with a specific preferred exterior size being 80 inches long (L), 45.69 inches wide (W) and 77.31 inches high (H). The foregoing provides a footprint of about 21 square feet inside the shed and about 126 cubic feet of space inside the shed. Sheds of the above dimensions can be packaged in a box that is no greater than 48" long×20" wide×10" high. It is to be understood that such a box is no greater than 48 inches long, no greater than 20 inches wide and no greater than 10 inches high (the "no greater than" term is distributed among each dimension of the box as recited herein).

Among other features as disclosed in the figures, advantages and objectives of the preferred embodiments of the present invention are preferably carried out by designing rear, front and side walls that are horizontal alignable and stacked together to provide the height as illustrated herein. Advantageously, sufficient structural strength, e.g. vertical column strength on the preferred sheds, which in the preferred embodiments are made of metal, is achieved by using posts that fit between the horizontal panels. For example, a shed constructed in accordance with the present invention that is at least 6' high will be preferably provided with posts that are spliced as illustrated in the accompanying figures. For example, with a preferred door also being at least 6' high, it is preferable to split the doors and vertically "stack" them to make a Dutch-style door, connected together by a locking pin, as disclosed and illustrated herein. In this way, a key feature of the present invention is providing a door to the shed, wherein the door is comprised of at least two (2) panels, each of which is at least 34 inches in height. Nowhere in the prior art is there a shed having a door constructed that is at least 68 inches in height (e.g. 34 inches×2) that can be packaged in a box no greater than 48" long×20" wide×10" high. In a preferred embodiment, the total height of the door(s) (e.g. DP1+DP2) when aligned vertically as shown in the completed shed figures, is greater than 69 inches, and preferably about 69.1 inches high.

Two (2) preferred designs include a peak roof style and a pent roof style, as illustrated herein, each of which are constructed to be at least 6 feet long and 40 inches wide, with a wall height of at least 6 feet, and which can be packaged into a box that is preferably no greater than 48" long×20" wide×10" high.

Constructing sheds that are of the aforementioned dimensions and structural integrity, such as those disclosed herein, are achieved by carrying out the assembly steps disclosed and illustrated herein. A preferred list of components for erecting one or more sheds disclosed herein is provided below in Table 1:

TABLE 1

| Key No. | Part No. | Part Description | Qty. |
|---|---|---|---|
| 1 | 65923 | Bolt (#8-32 × 3/8) (10 mm) | 63 |
| 2 | 65103 | Hex Nut (#8-32) | 63 |
| 3 | 65004 | Screw (#8AB × 5/16) (8 mm) | 266 |
| 4 | 66646 | Washer Sheet | 3 |
| 5 | 66715 | Door Handle | 1 |
| 6 | 66718 | Hinge | 4 |
| 7 | 66720 | Padlock Eyelet | 2 |
| 8 | 60H | Corner Cap | 4 |
| 9 | 66870 | Plastic Trim | 2 |
| 10 | 66871 | Plastic Corner Trim | 3 |
| 11 | 66808 | Latch Spring | 1 |
| 12 | 66721 | U-Nut (Door Clip) | 8 |
| 13 | 66866 | Door Closure Clip | 4 |
| 14 | 11137 | Mounting Plate | 2 |
| 15 | 11113 | Front/Rear Floor Frame | 4 |
| 16 | 11114 | Side Floor Frame | 2 |
| 17 | 11115 | Splice Post | 4 |
| 18 | 11116 | Corner Post | 6 |
| 19 | 11117 | Wall Panel | 15 |
| 20 | 11118 | Side Panel | 10 |
| 21 | 11119 | Front Wall Panel | 5 |
| 22 | 11120 | Right Door Jamb Top | 1 |
| 23 | 80135 | Right Door Jamb Bottom | 1 |
| 24 | 11122 | Left Door Jamb Top | 1 |
| 25 | 80137 | Left Door Jamb Bottom | 1 |
| 26 | 11124 | Header | 2 |
| 27 | 11125 | Rear Wall Angle | 2 |
| 28 | 11126 | Side Wall Angle | 2 |
| 29 | 11127 | Gable Angle | 2 |
| 30 | 11128 | Door Panel | 2 |
| 31 | 11129 | Door Panel | 2 |
| 32 | 11130 | Door Panel, Half | 2 |
| 33 | 11131 | Horizontal Door Brace | 4 |
| 34 | 11132 | Vertical Door Brace | 2 |
| 35 | 11133 | Vertical Door Brace | 2 |
| 36 | 11134 | Door Astragal | 1 |
| 37 | 11135 | Corner Splice Angle | 3 |
| 38 | 11138 | Door Jamb Support | 4 |
| 39 | 11139 | Diagonal Door Brace | 4 |
| 40 | 11140 | Gable Right | 1 |
| 41 | 11141 | Header, Front | 2 |
| 42 | 11142 | Roof Channel Right | 2 |
| 43 | 11143 | Roof Channel Left | 2 |
| 44 | 11144 | Fascia Trim | 2 |
| 45 | 11145 | Roof Panel | 5 |
| 46 | 11146 | Roof Panel Right | 1 |
| 47 | 80131 | Gable Left | 1 |
| 48 | 80133 | Roof Panel Left | 1 |
| 49 | 11136 | Stud Splice | 2 |
| 50 | 11019 | Channel Splice | 2 |

Figure 2:
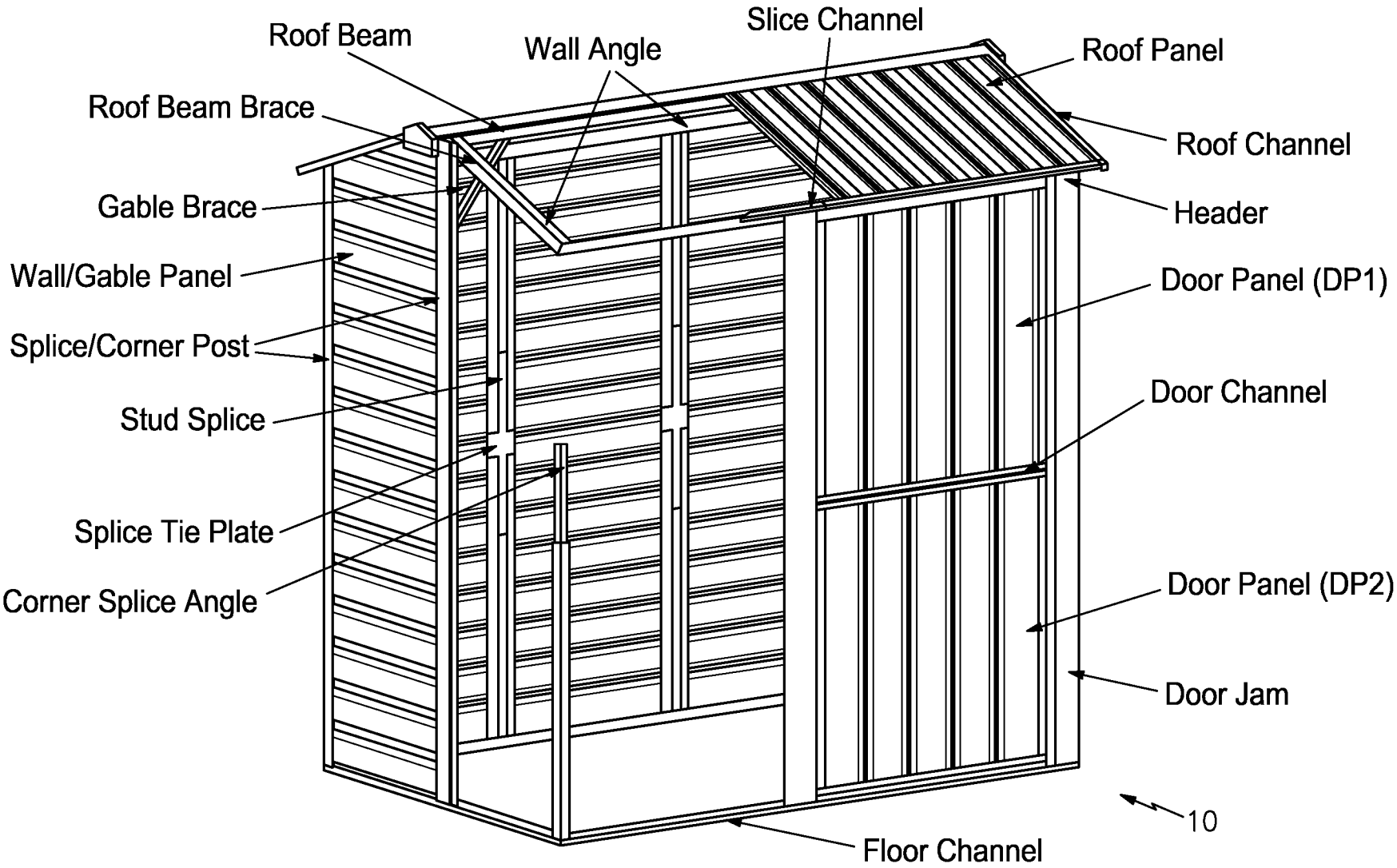
FIG. 2 is a view of an anatomy of a shed of a second embodiment constructed in accordance with the present invention.
Figure 3:
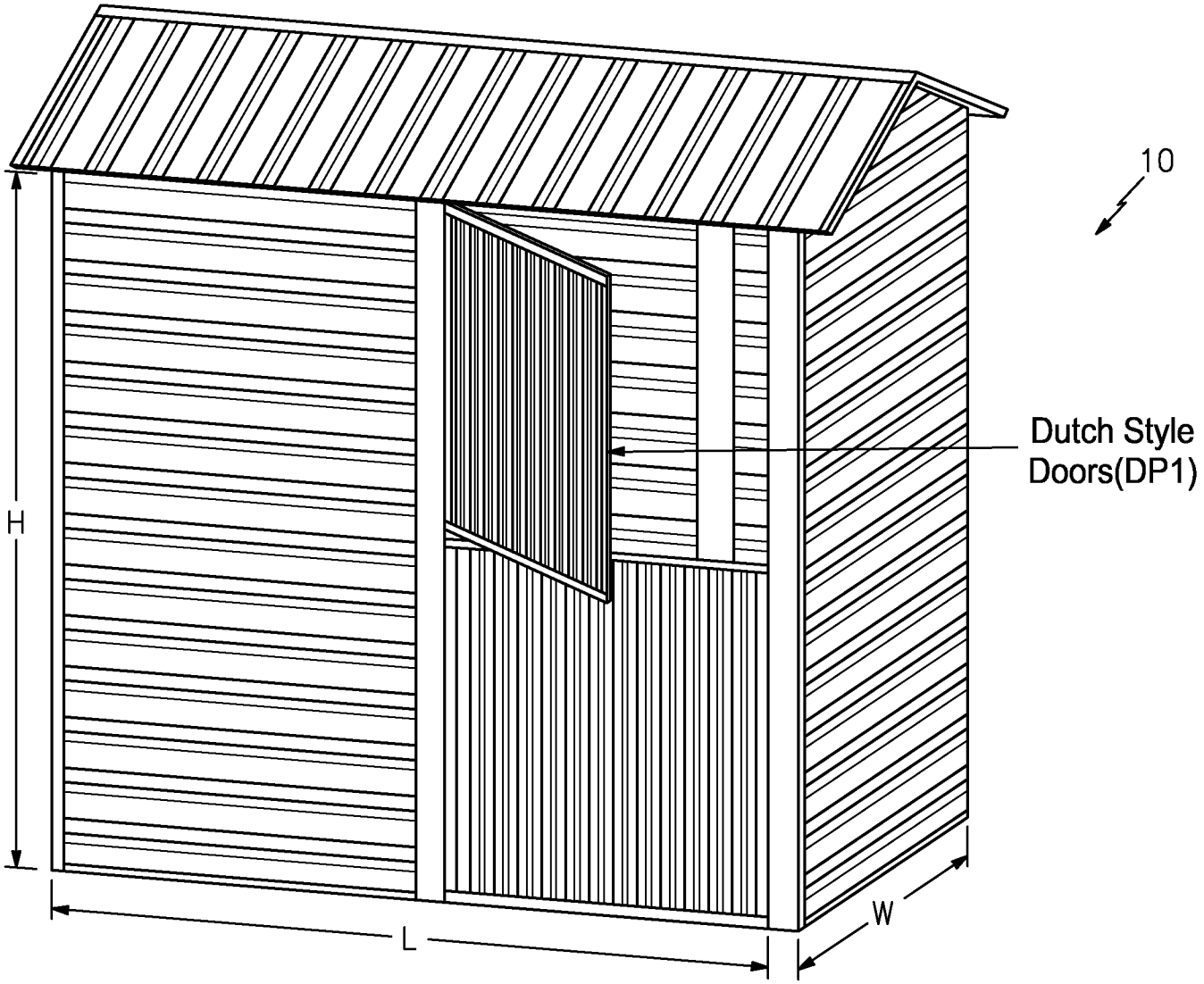
FIG. 3 is an overview view of a shed constructed in accordance with the present invention.

With the above parts list, preferred sheds can be constructed. For example, FIGS. 1, 2 and 3 illustrate sheds, generally indicated at 10, constructed in accordance with the present invention. The dimensions of the preferred sheds is indicated in the figures as L (long)×W (wide)×H (height), with the dimensions therefor being referenced herein, e.g. at least 6 feet long, at least 40 inches wide and at least 6 feet high.

Figure 4:
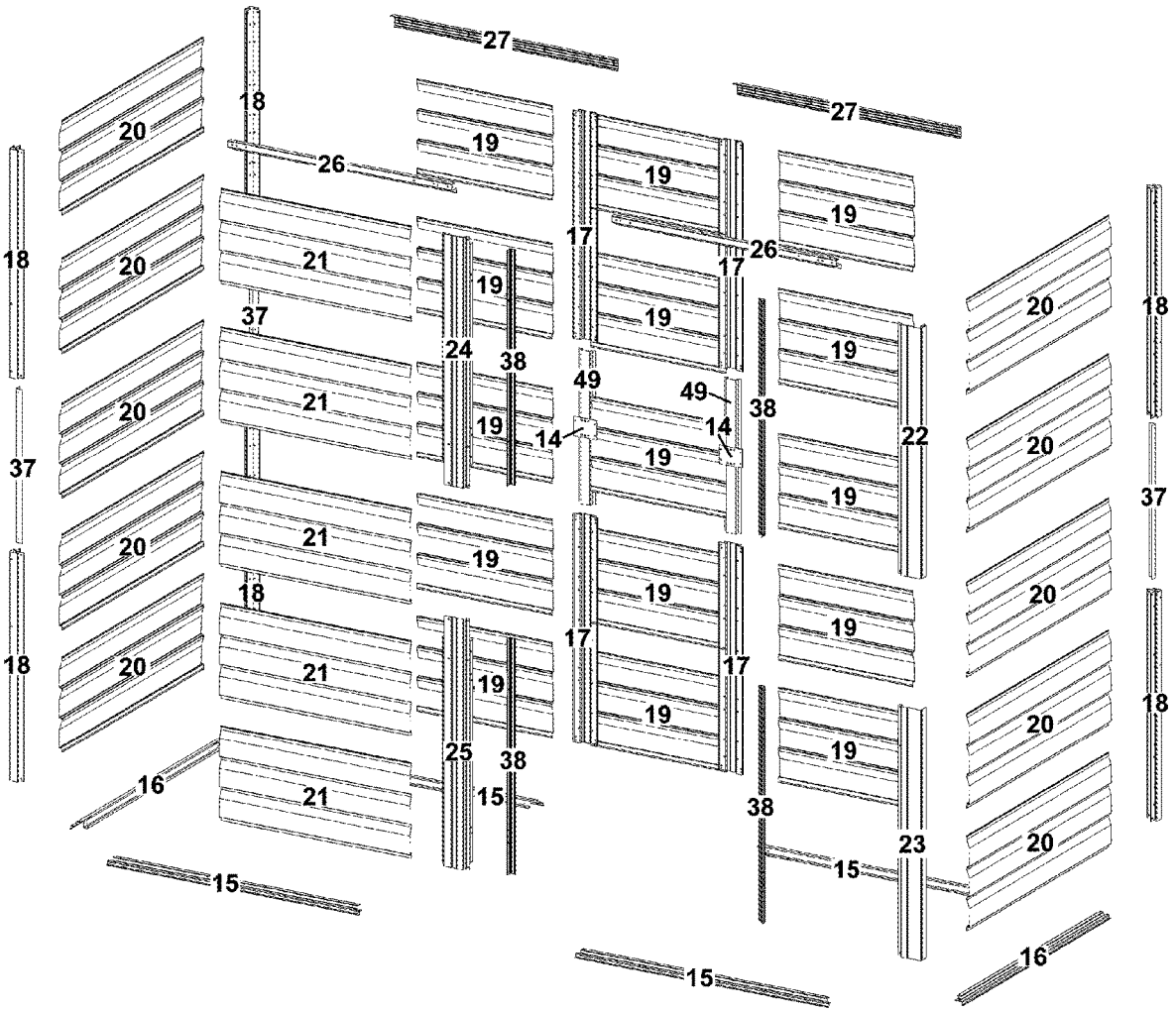
FIG. 4 is an assembly view of certain components and certain assembly steps in constructing the preferred shed constructions of the present invention, and in particular, highlights the assembly of the walls of the one or more erectable shed embodiments and with particular reference to the assembly of the wall panels, side panels and posts illustrated therein.
Figure 5:
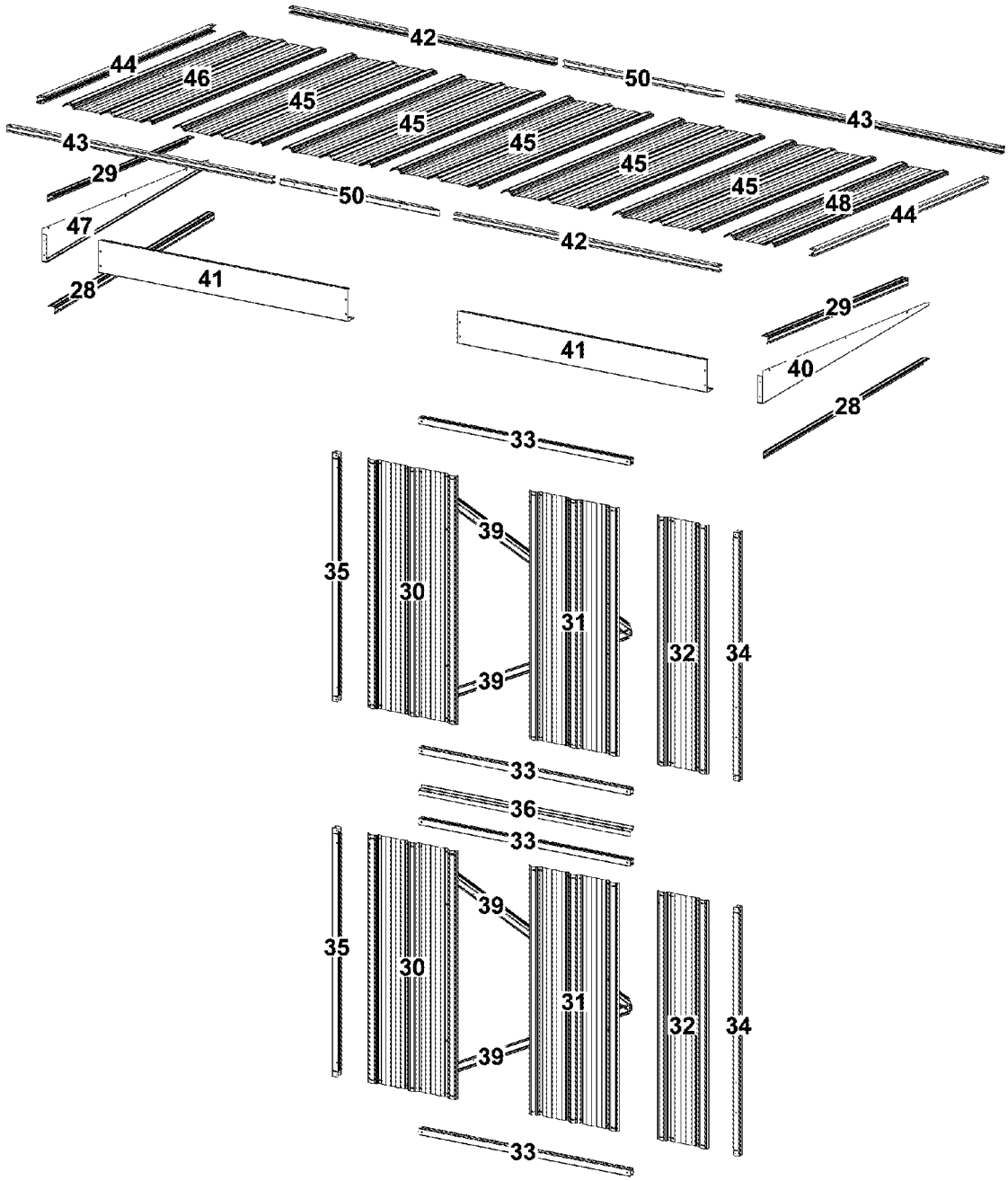
FIG. 5 is an assembly view of certain components and certain assembly steps in constructing the preferred shed constructions of the present invention, and in particular, highlights the assembly of the roof and door of the one or more erectable shed embodiments and with particular reference to the roof panels and door panels illustrated therein.
Figure 6A:
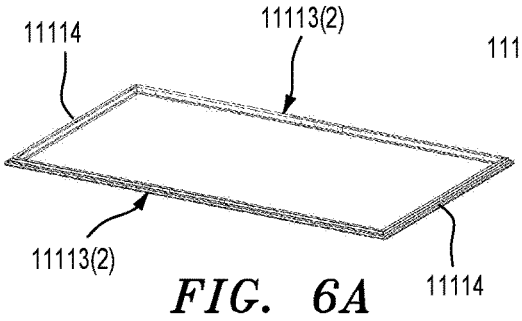
FIGS. 6A, 6B, 6C, 6D, 6E, and 6F are assembly overviews showing certain components and certain assembly steps in constructing one or more of the preferred shed constructions of the present invention, and in particular, highlights the assembly of the front, rear, and side walls, the roof and door and provides views thereof in various stages of assembly.
Figure 6B:
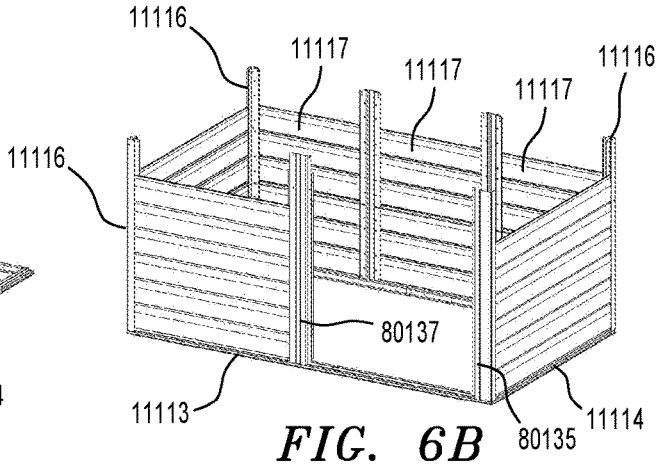
Figure 6C:
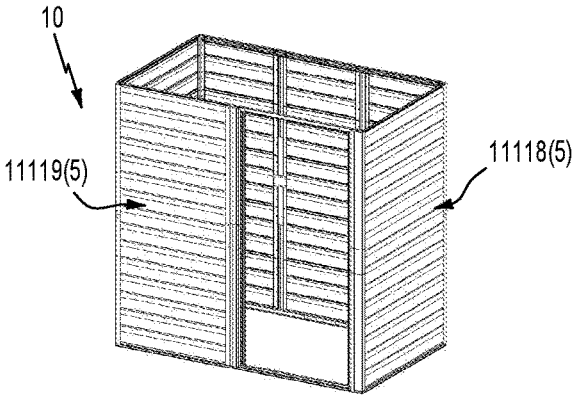
Figure 6D:
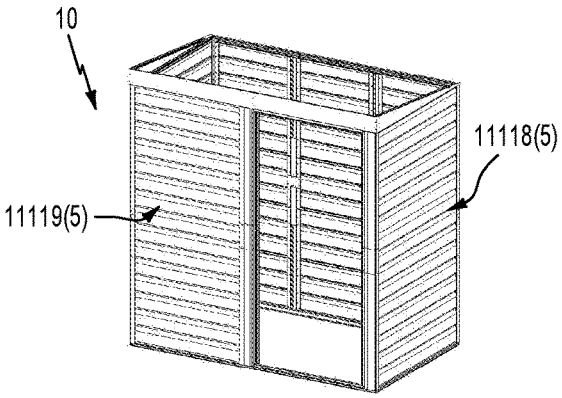
Figure 6E:
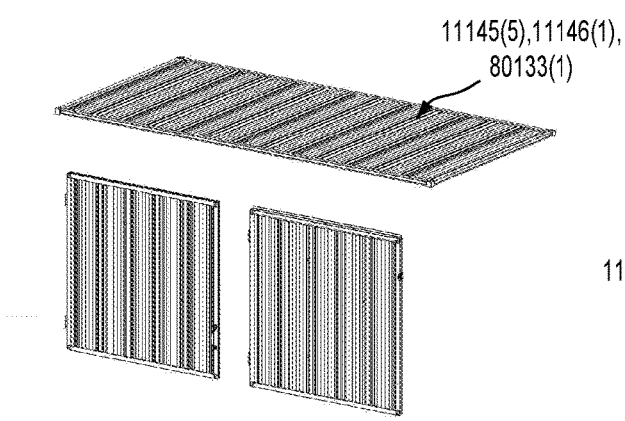
Figure 6F:
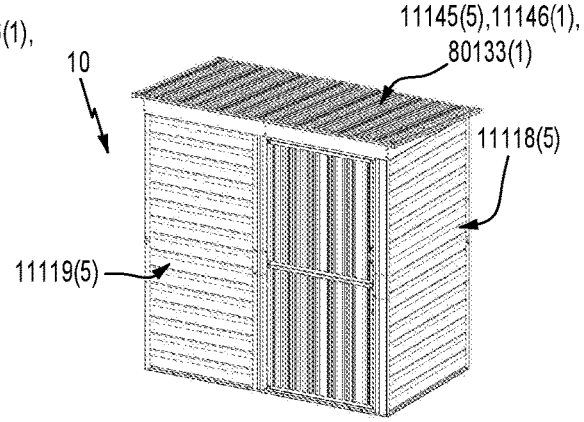
Figure 7:
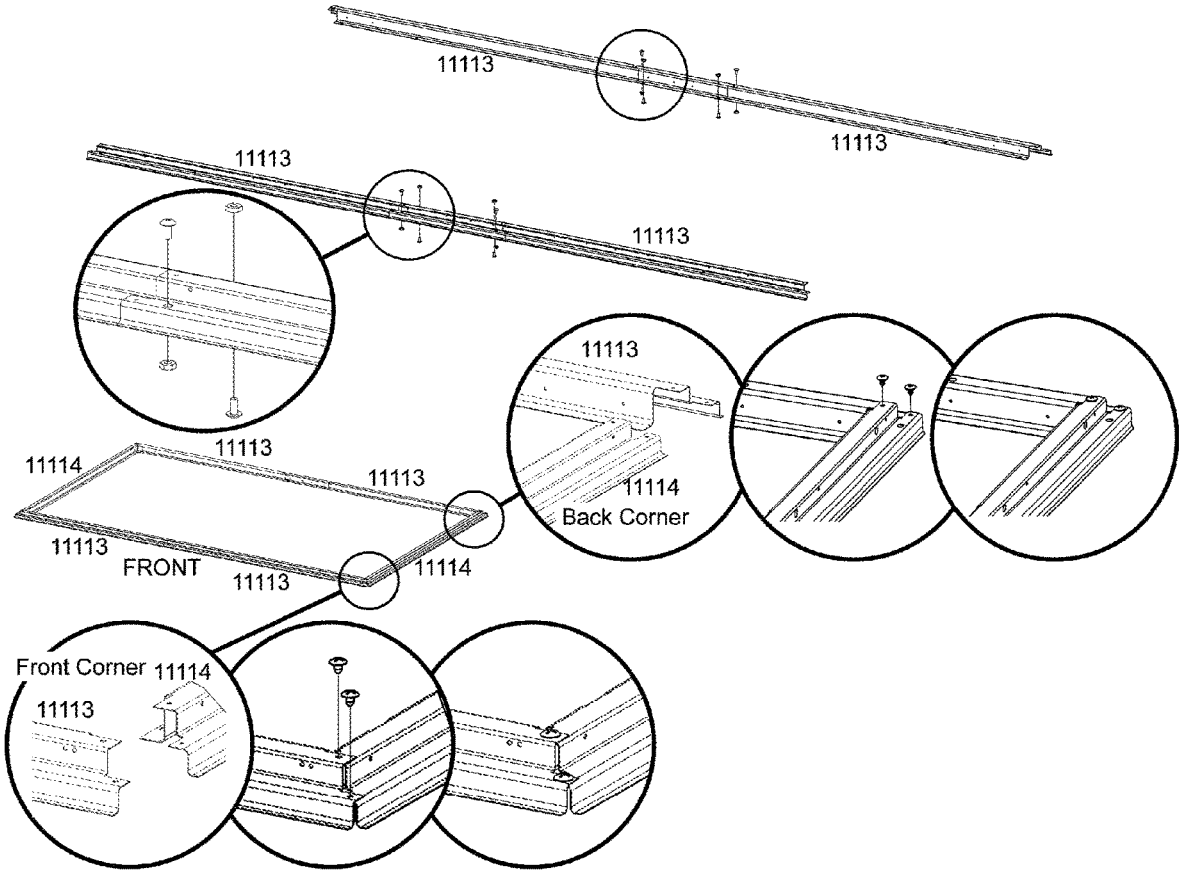
FIG. 7 is an assembly view of certain components and certain assembly steps in constructing the preferred shed constructions of the present invention, and in particular, highlights the assembly of the floor for the one or more erectable sheds of the present invention.
Figure 8A:
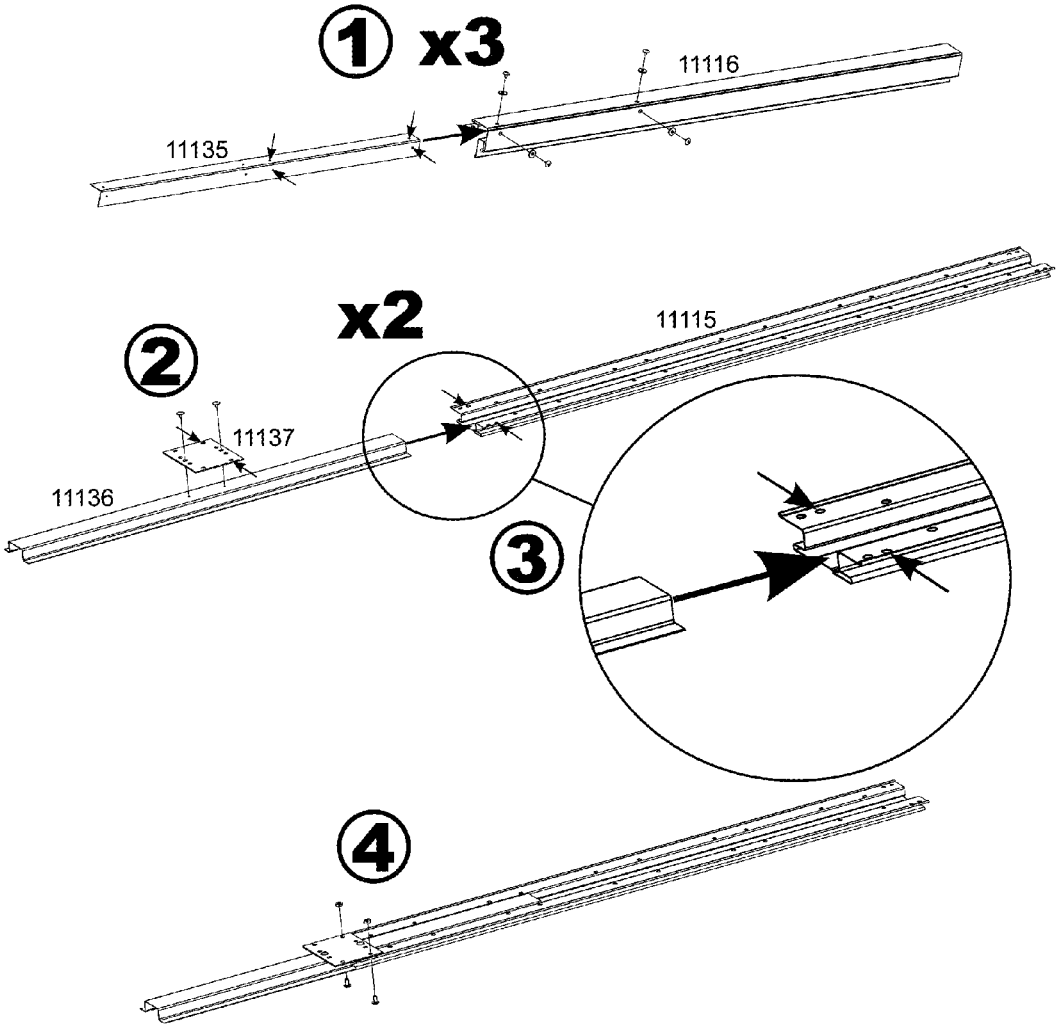
FIGS. 8A, 8B, 8C, 8D, and 8E are assembly views of certain components and certain assembly steps in constructing the bottom wall assembly for one or more of the preferred shed constructions of the present invention.
Figure 8B:
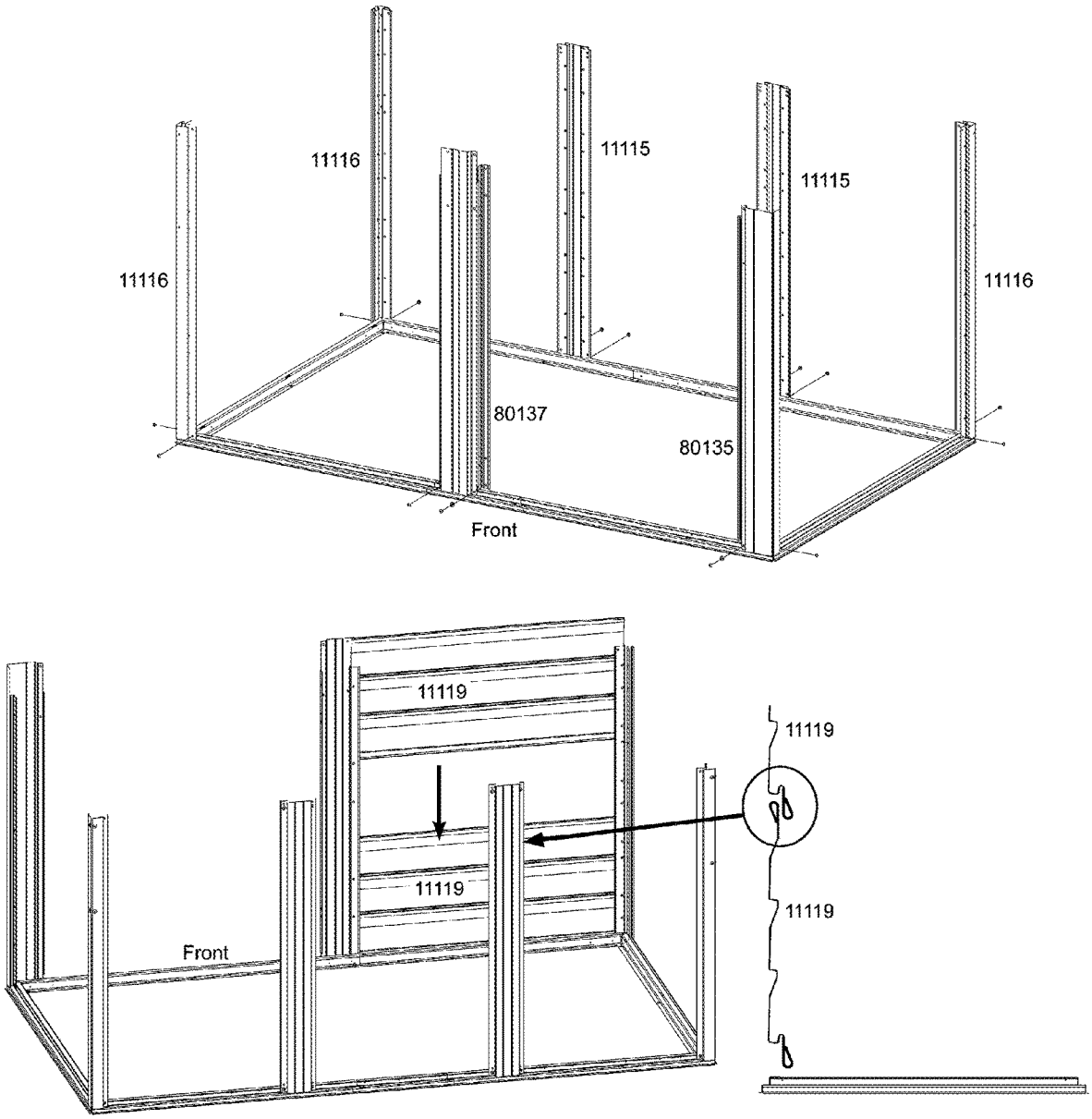
Figure 8C:
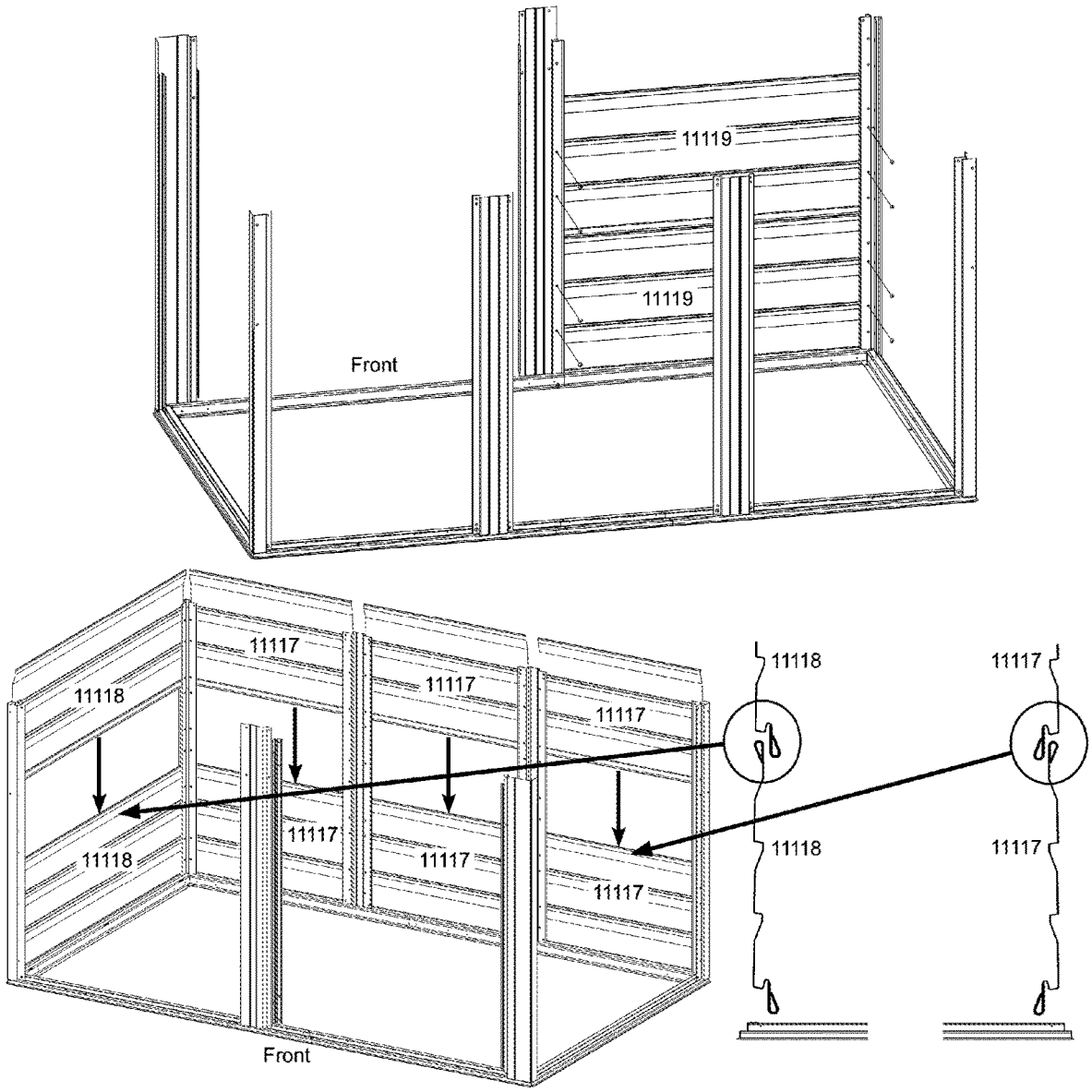
Figure 8D:
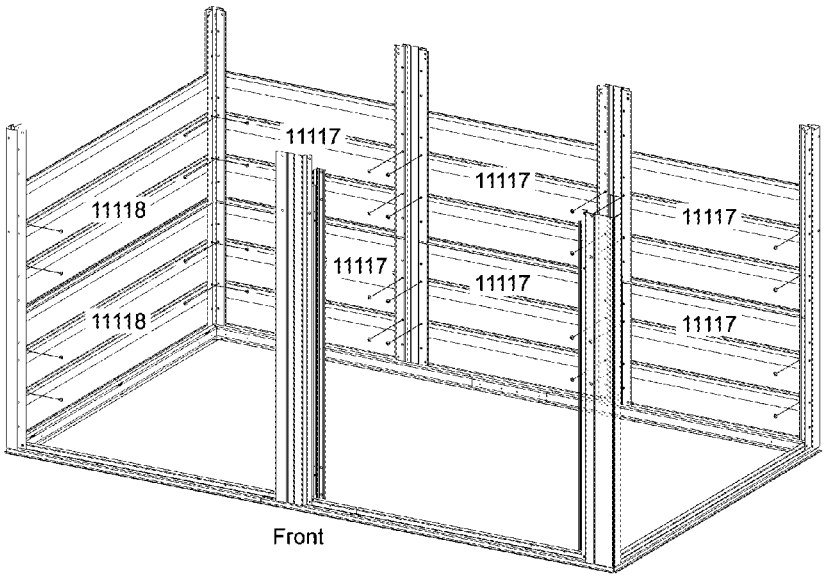
Figure 8D:
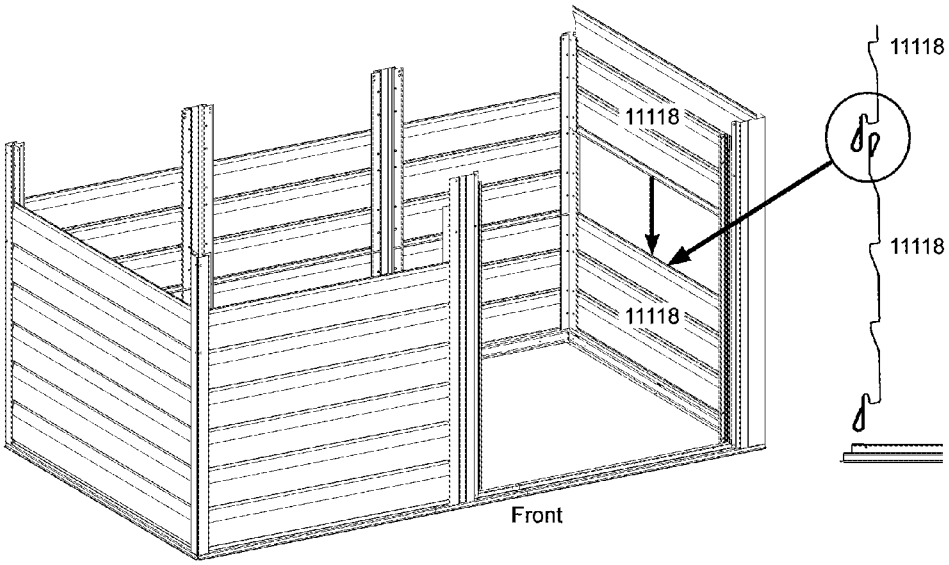
Figure 8E:
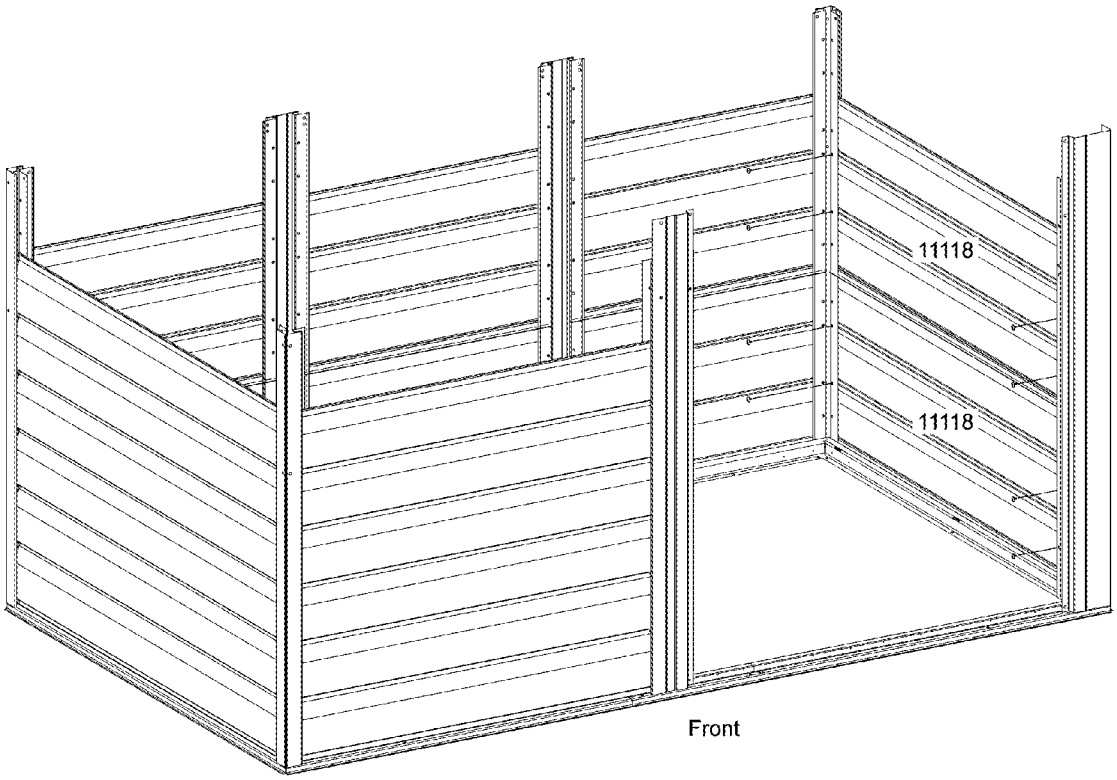
Figure 9A:
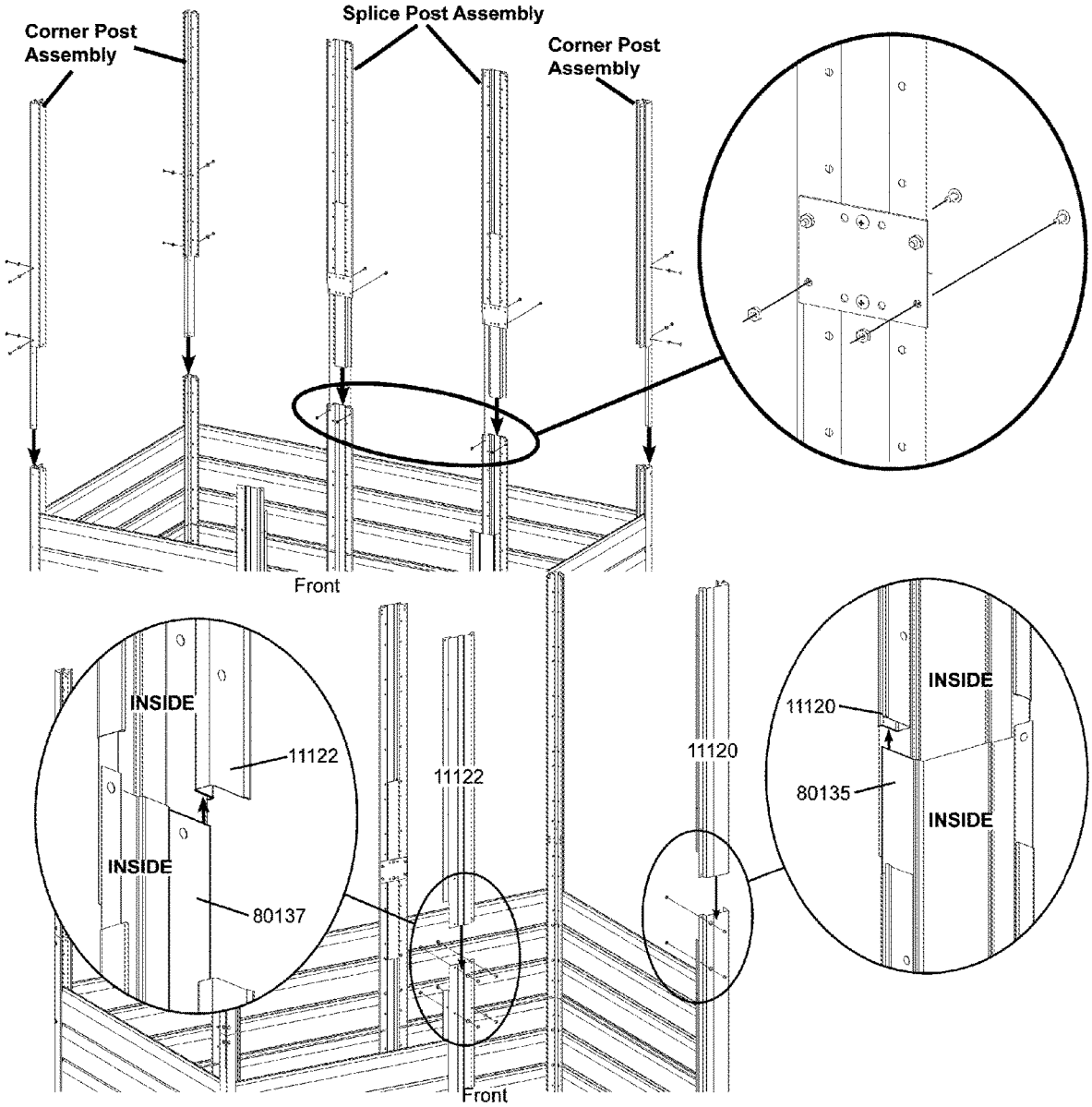
FIGS. 9A, 9B, 9C, 9D, and 9E are assembly views of certain components and certain assembly steps in constructing the top wall assembly for one or more of the preferred shed constructions of the present invention.
Figure 9B:
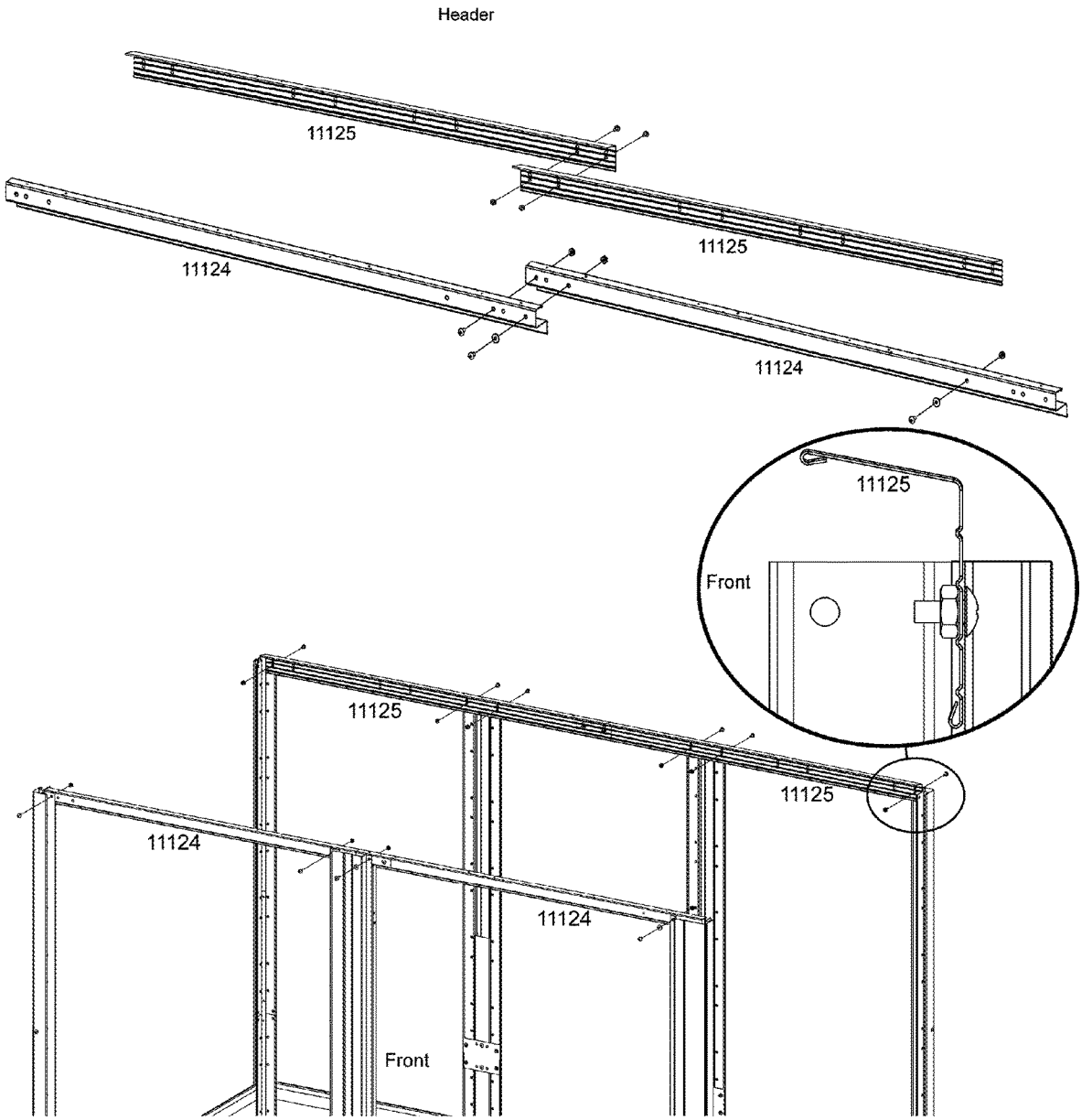
Figure 9C:
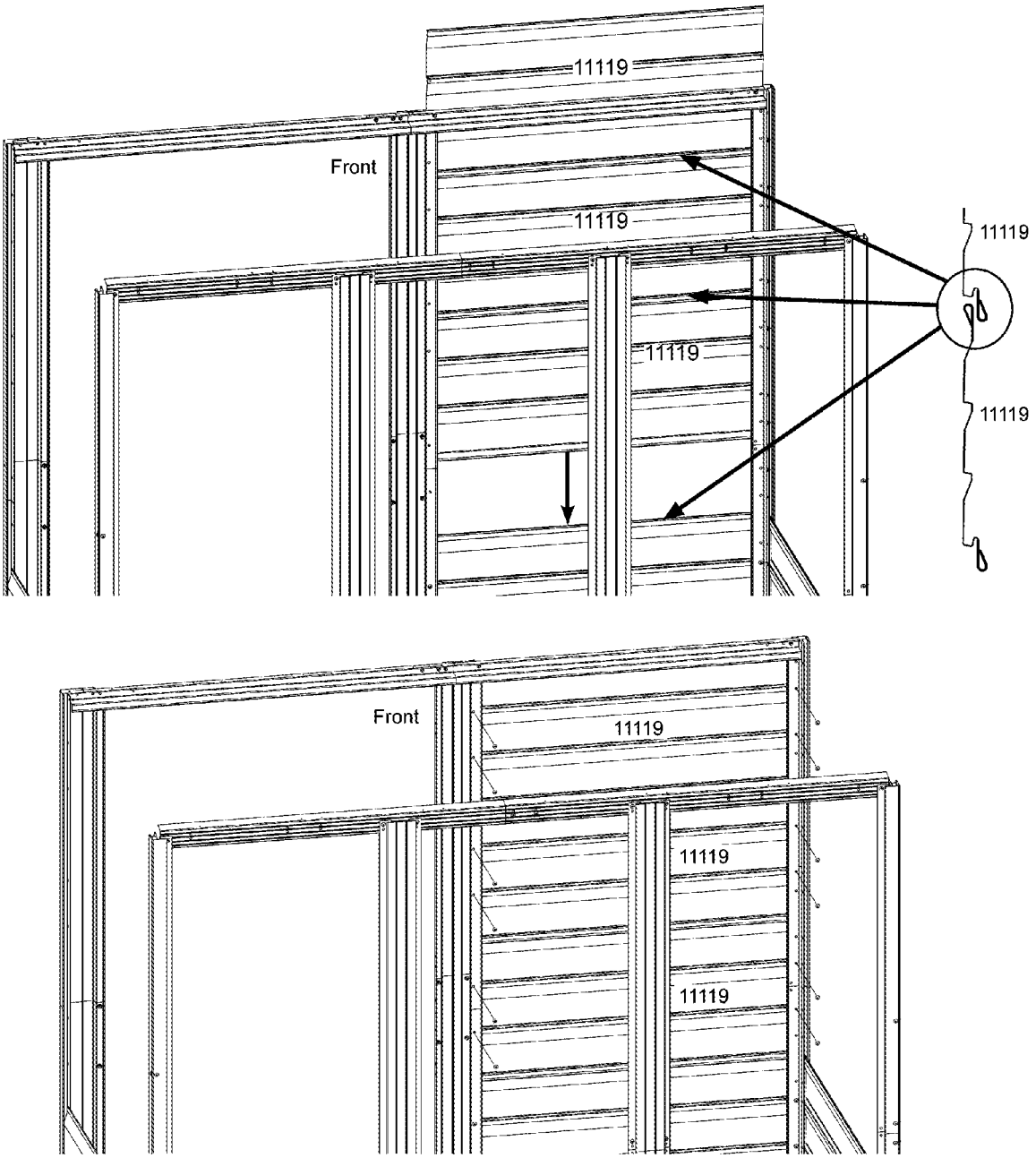
Figure 9D:
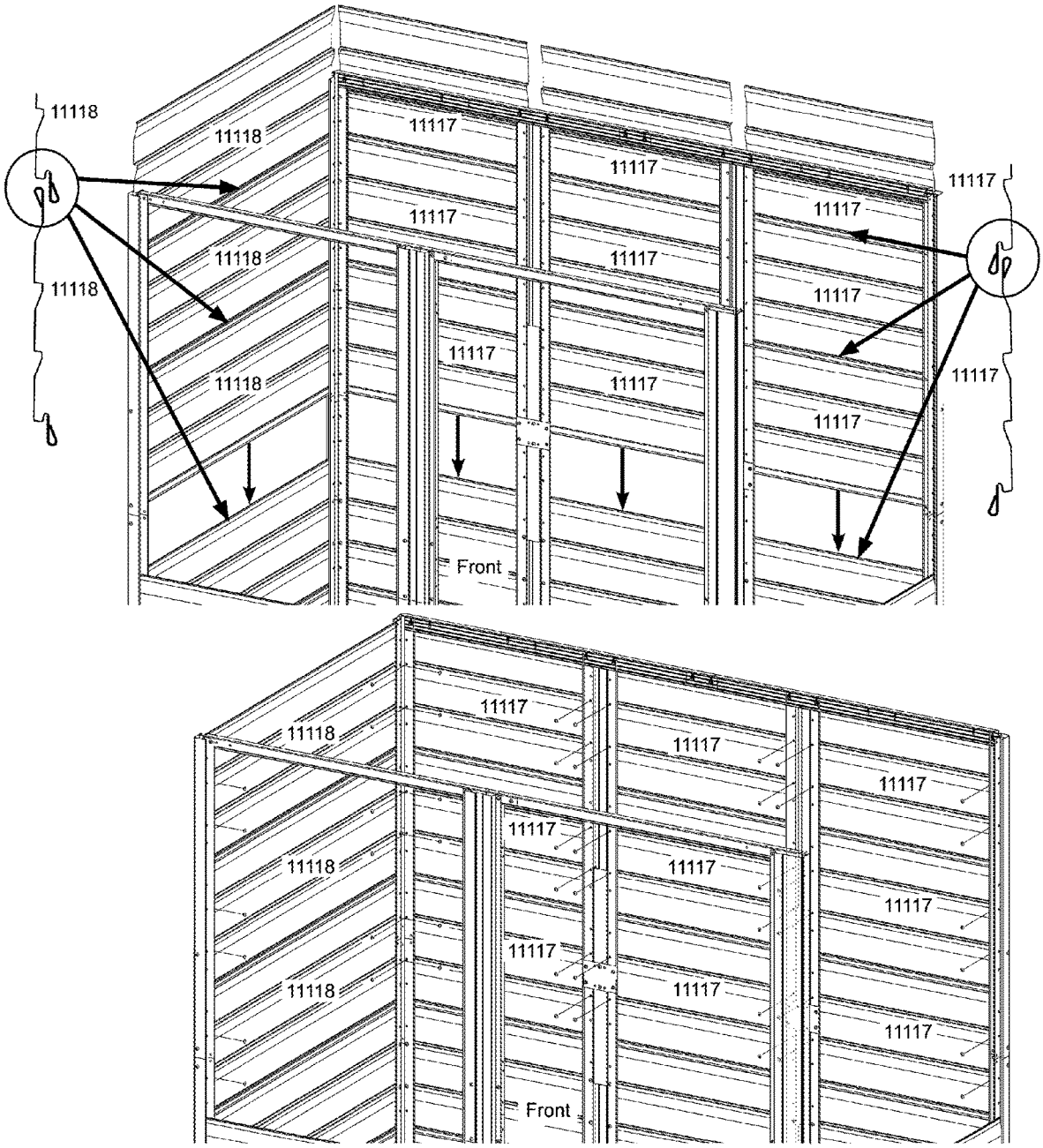
Figure 9E:
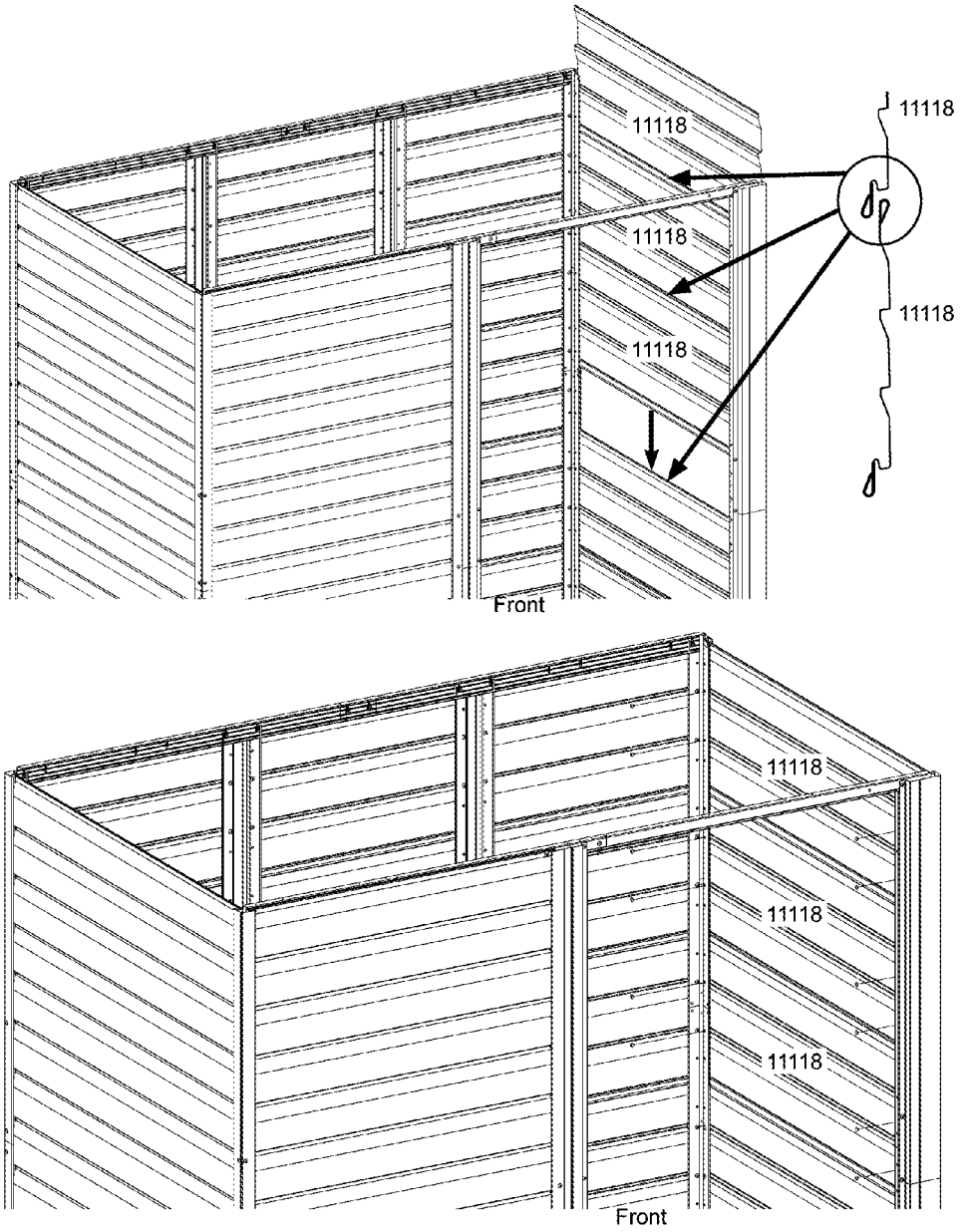

In particular, FIG. 4 is an assembly view of certain components and certain assembly steps in constructing one or more of the preferred shed constructions of the present invention, and in particular, highlights the assembly of the walls of the one or more erectable shed embodiments with particular reference to the wall panels and side panels and posts illustrated therein. FIG. 5 illustrates components and certain assembly steps in constructing the door and roof for preferred embodiments of the erectable sheds disclosed herein. FIGS. 6A, 6B, 6C, 6D, 6E, and 6F are assembly overviews showing components and certain assembly steps in constructing the walls, roof and door of sheds in accordance with the present invention, while FIG. 7 illustrates certain assembly steps in constructing the floor assembly of the preferred shed constructions of the present invention.

Furthermore FIGS. 8A, 8B, 8C, 8D, and 8E illustrate certain assembly steps in constructing the bottom wall assembly for one or more of the preferred sheds disclosed herein and FIGS. 9A, 9B, 9C, 9D, and 9E illustrate certain assembly steps in constructing the top wall assembly for one or more of the preferred shed constructions of the present invention.

Figure 10A:
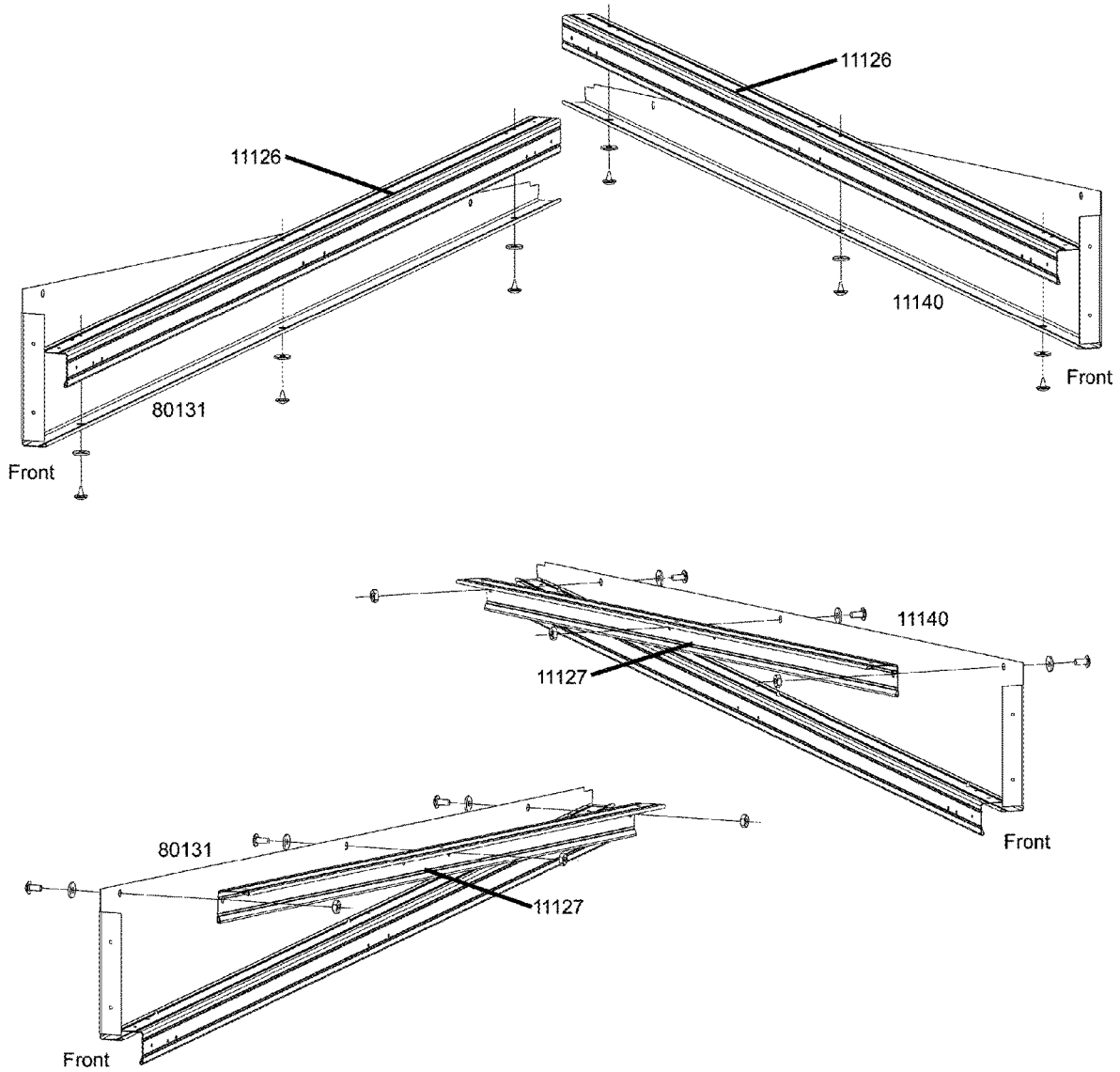
FIGS. 10A, 10B, and 10C are assembly views of certain components and certain assembly steps for the gable assembly for one or more of the preferred shed constructions of the present invention.
Figure 10B:
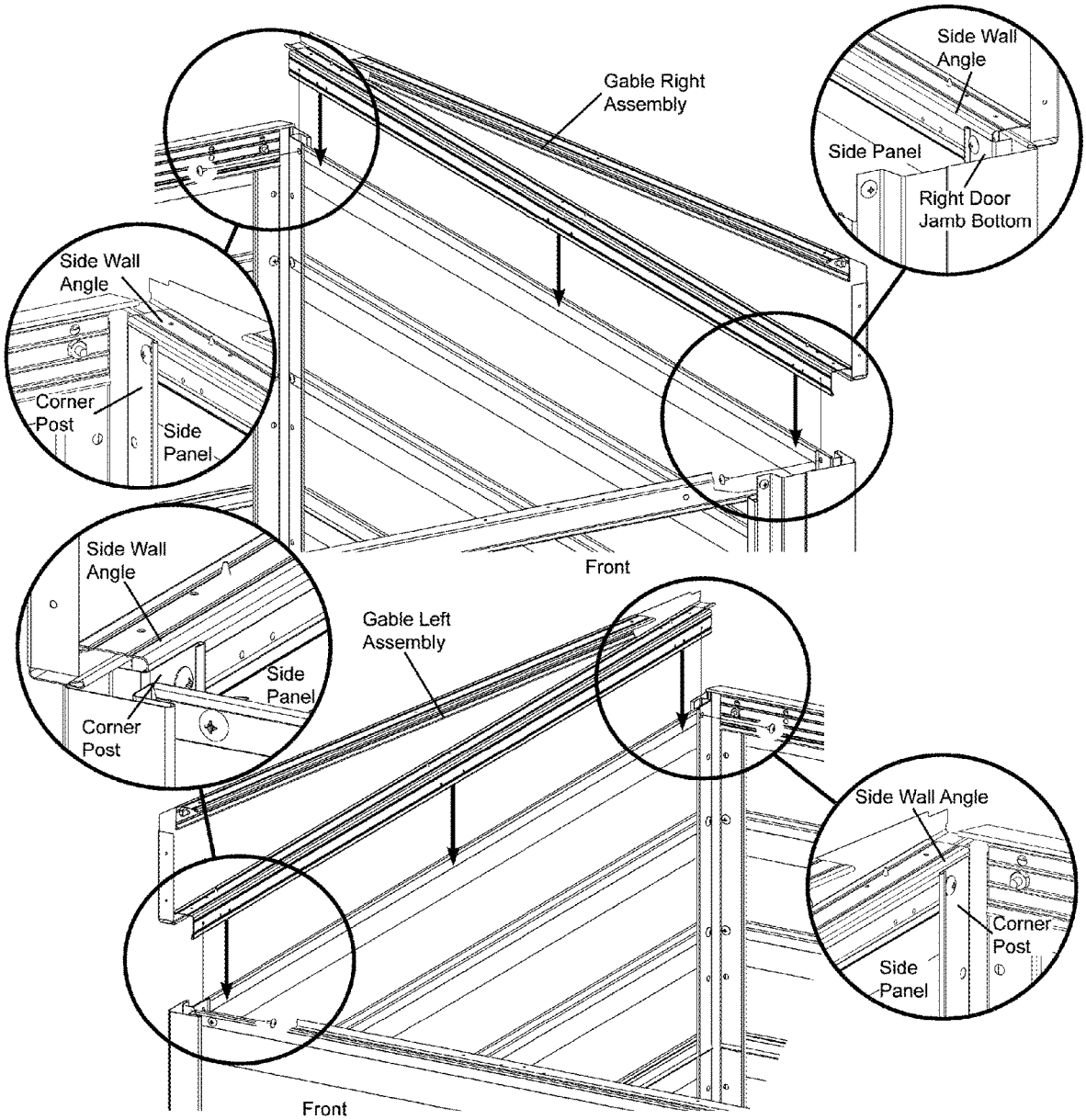
Figure 10C:
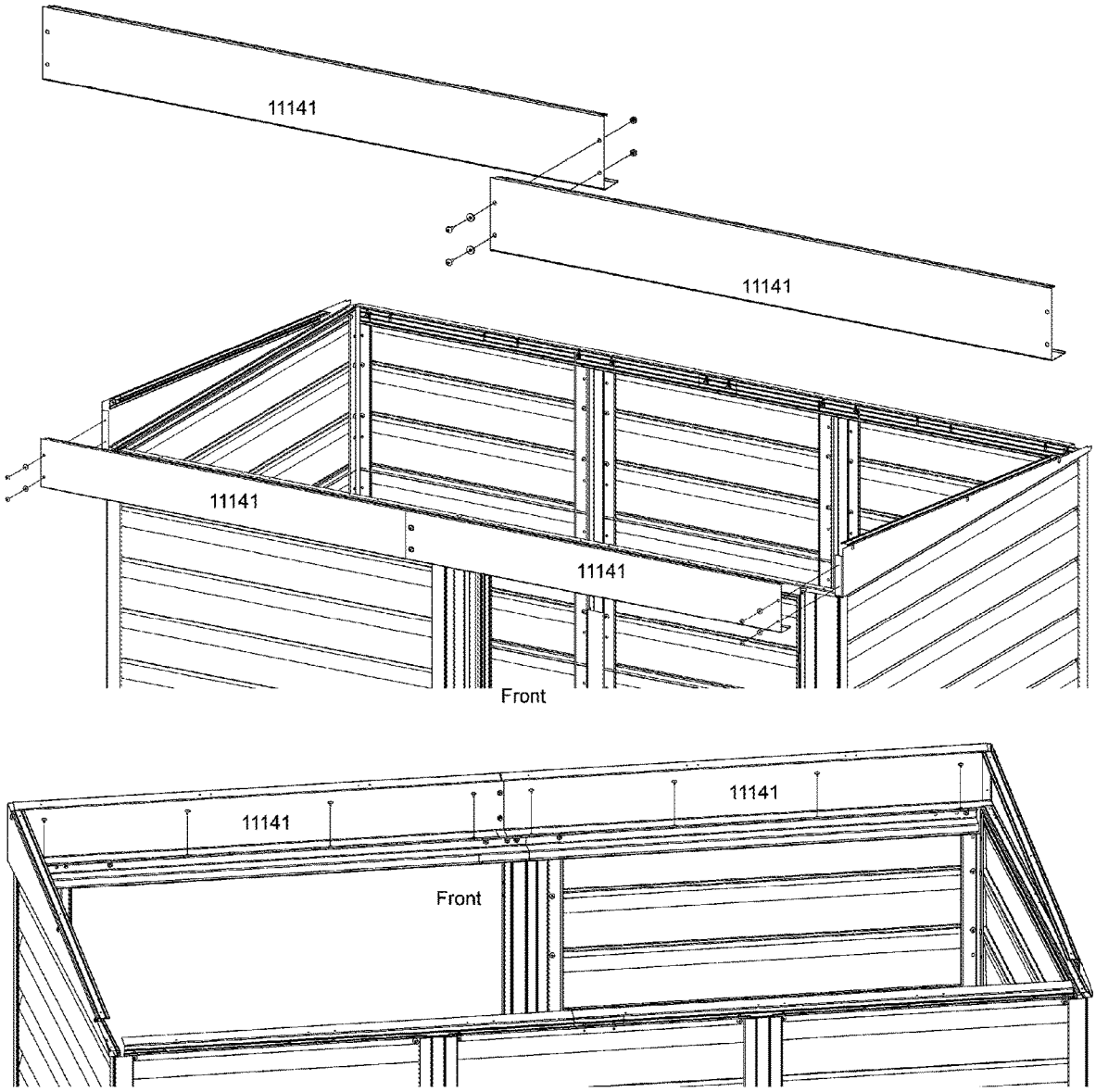
Figure 11A:
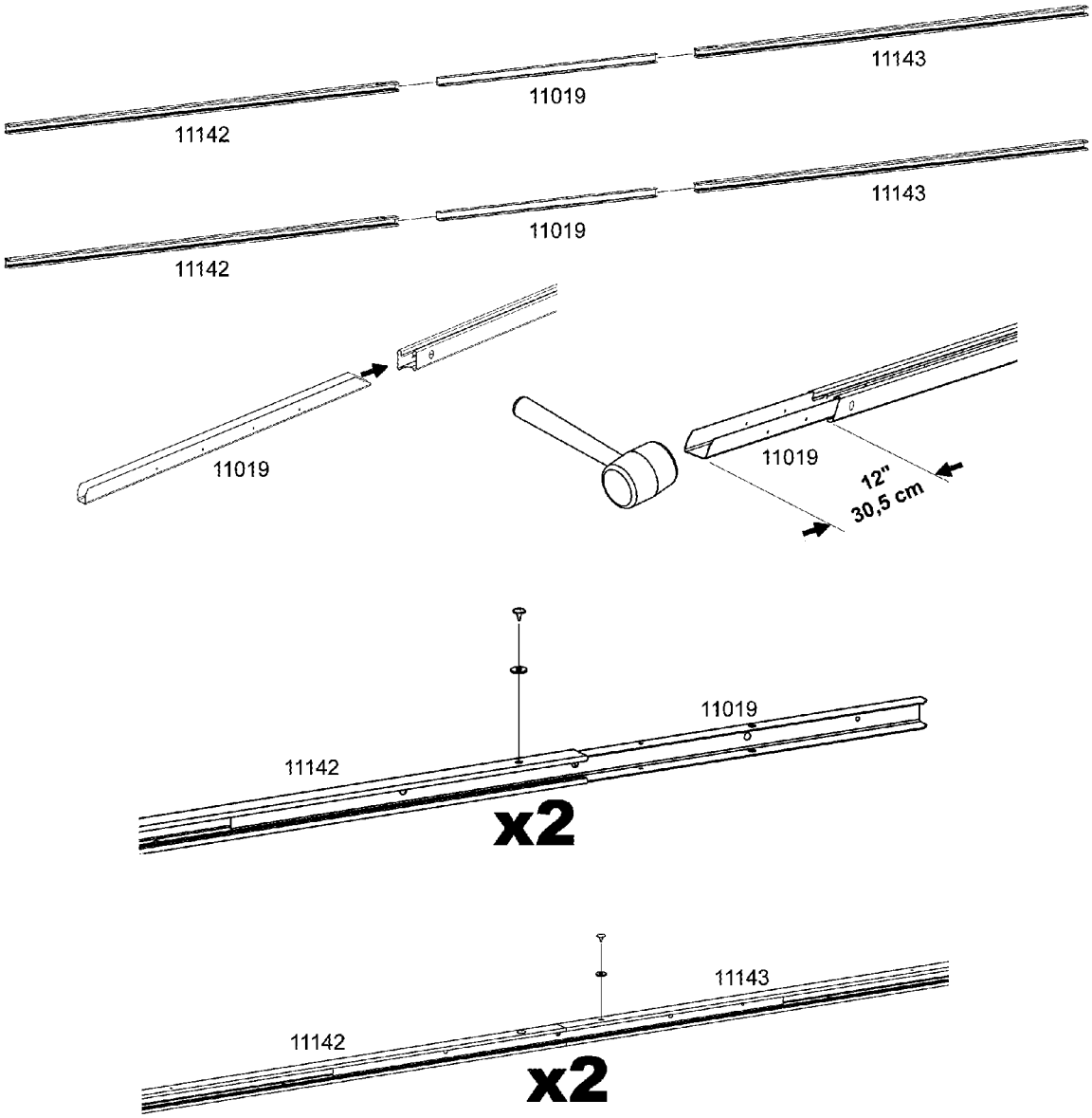
FIGS. 11A and 11B are assembly views of certain components and certain assembly steps in constructing the roof for one or more of the preferred shed constructions of the present invention.
Figure 11B:
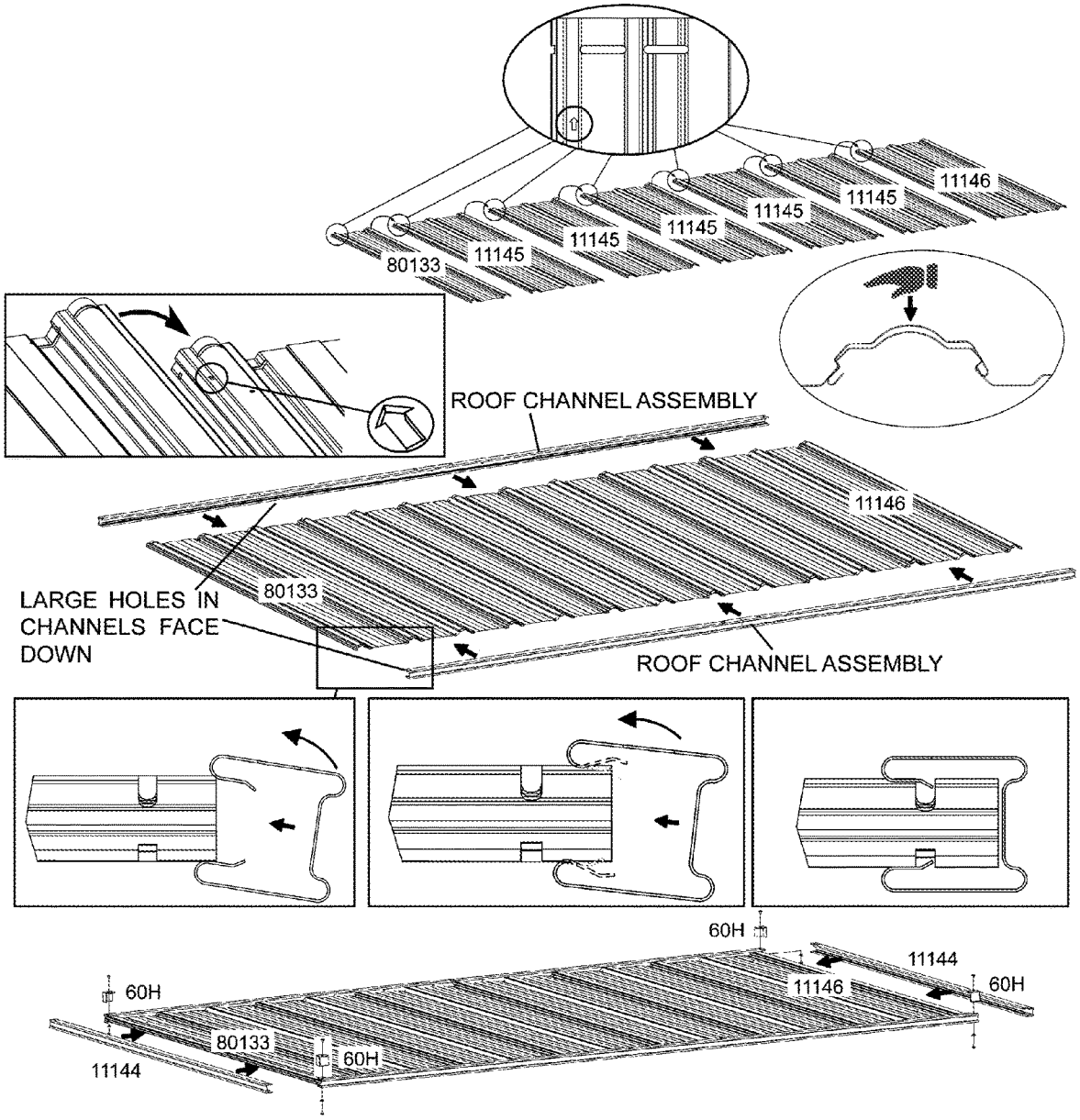
Figure 12A:
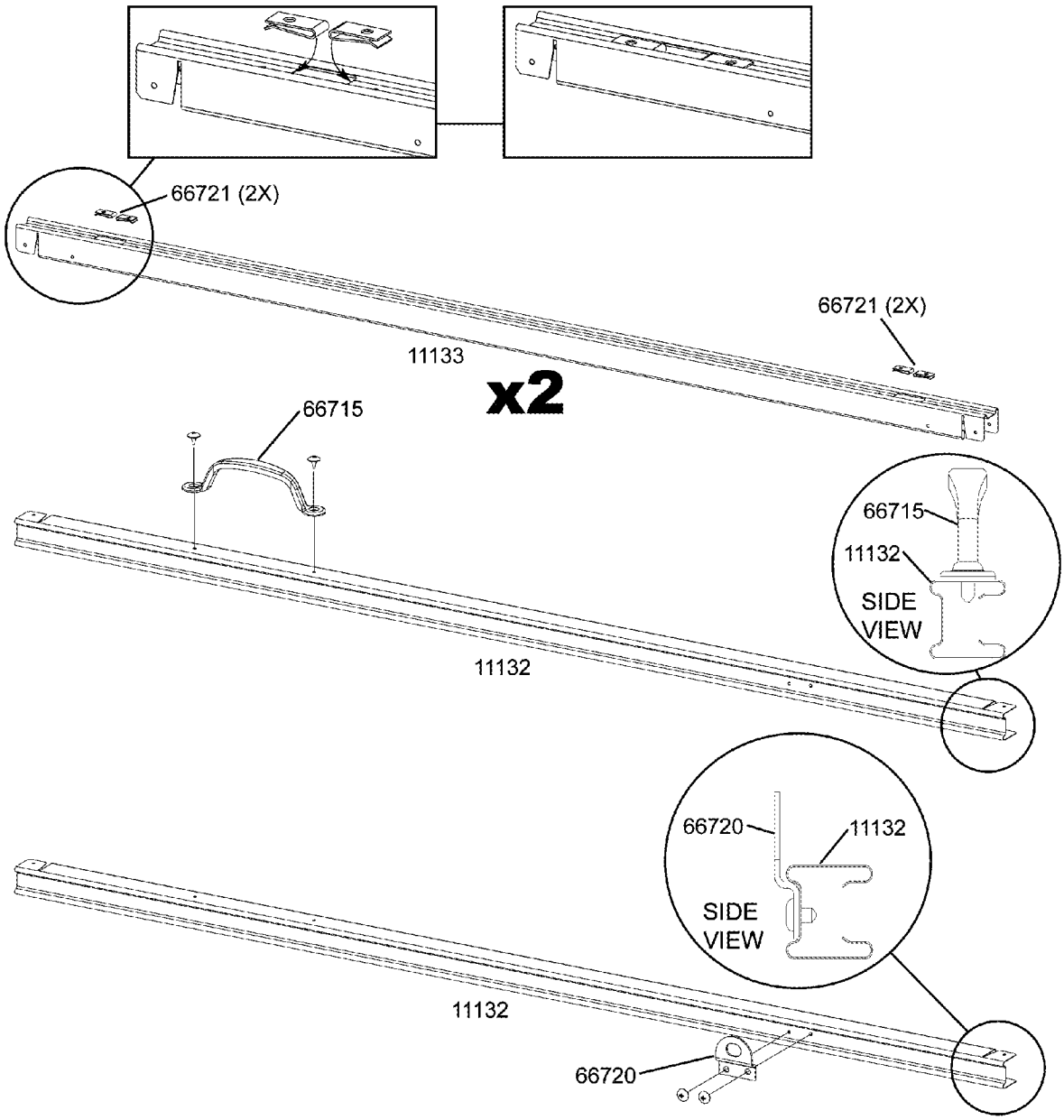
FIGS. 12A, 12B, 12C, and 12D are assembly views of certain components and certain assembly steps in constructing a preferred door for one or more of the preferred shed constructions of the present invention.
Figure 12B:
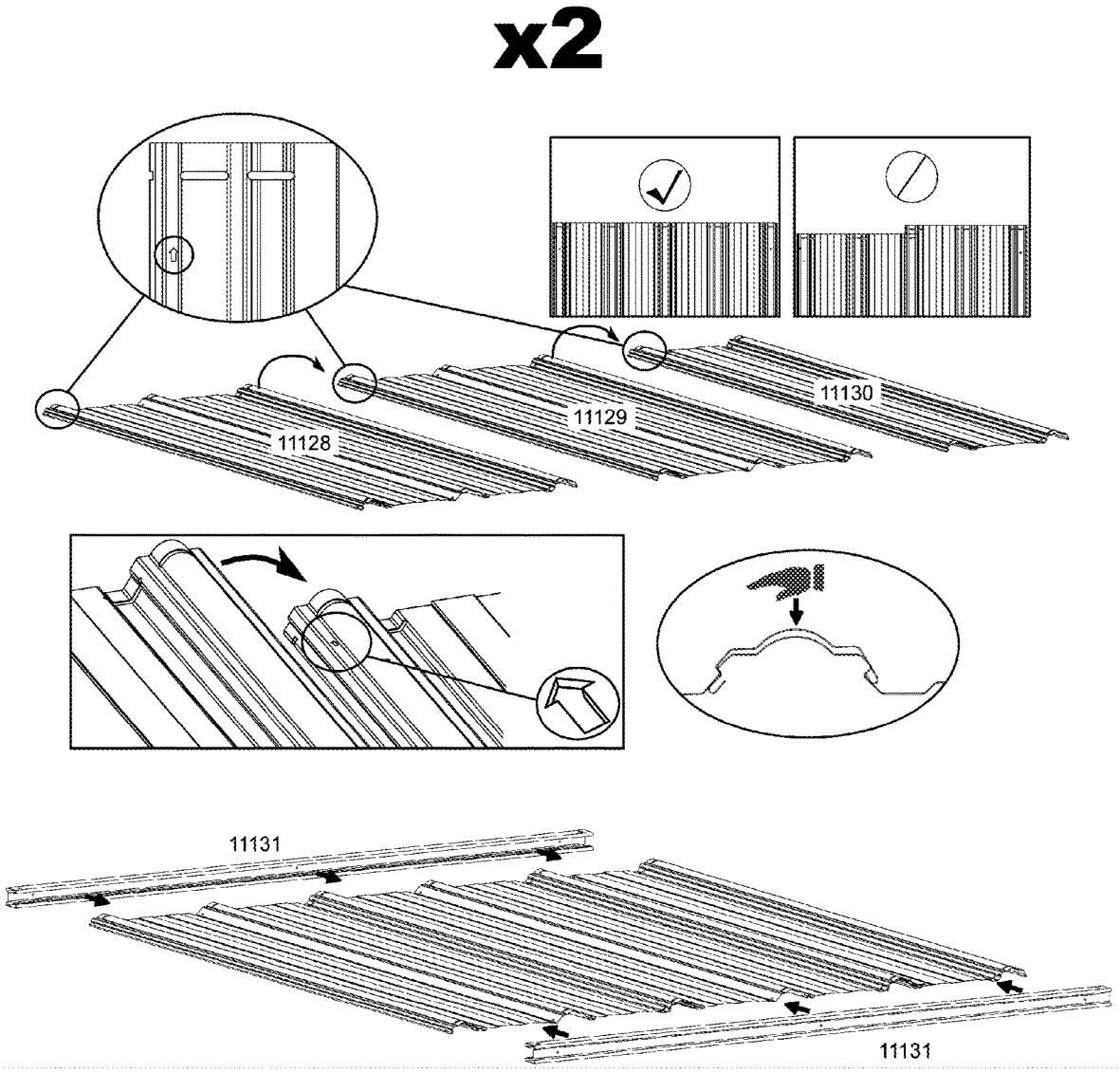
Figure 12C:
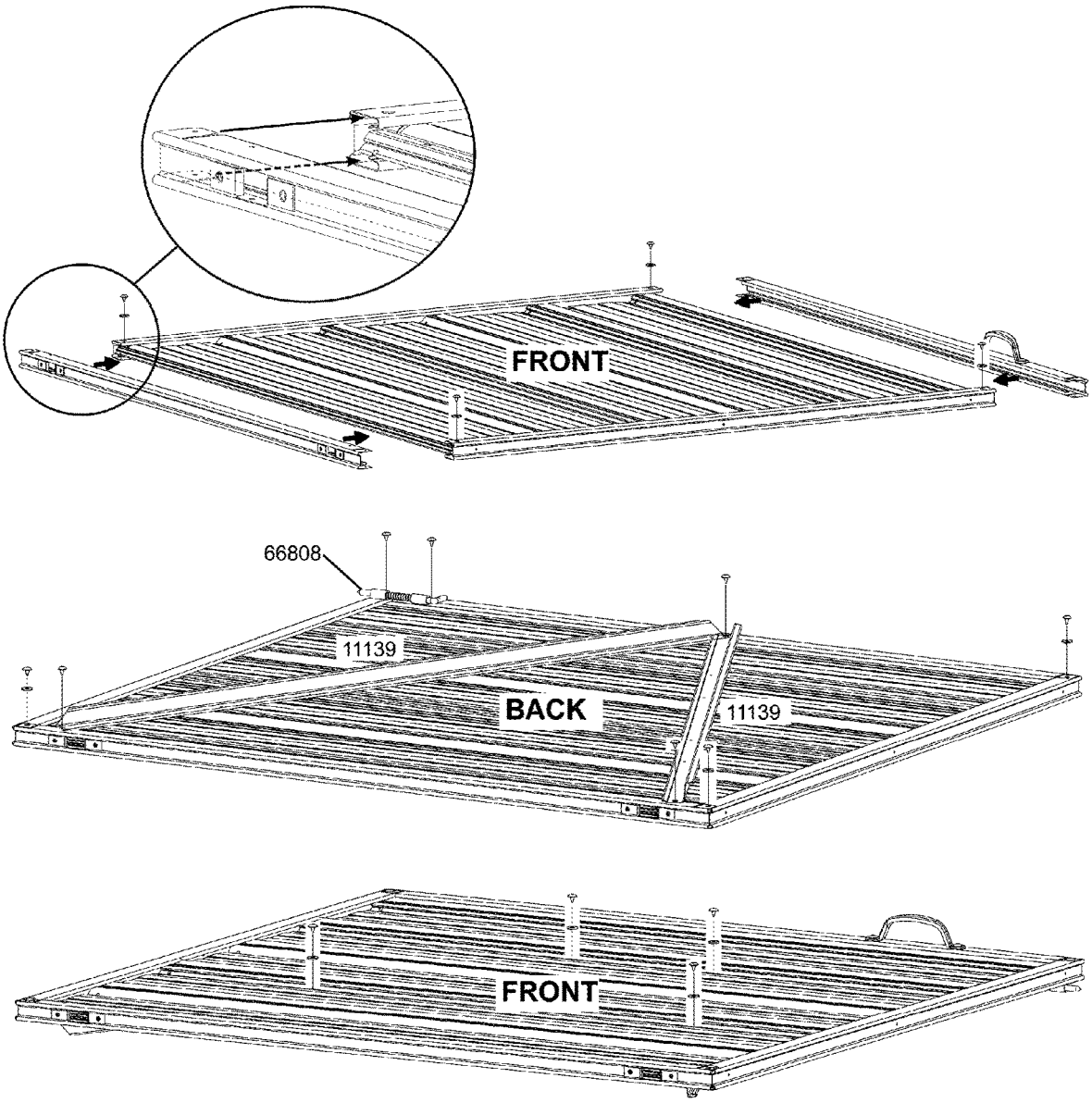
Figure 12D:
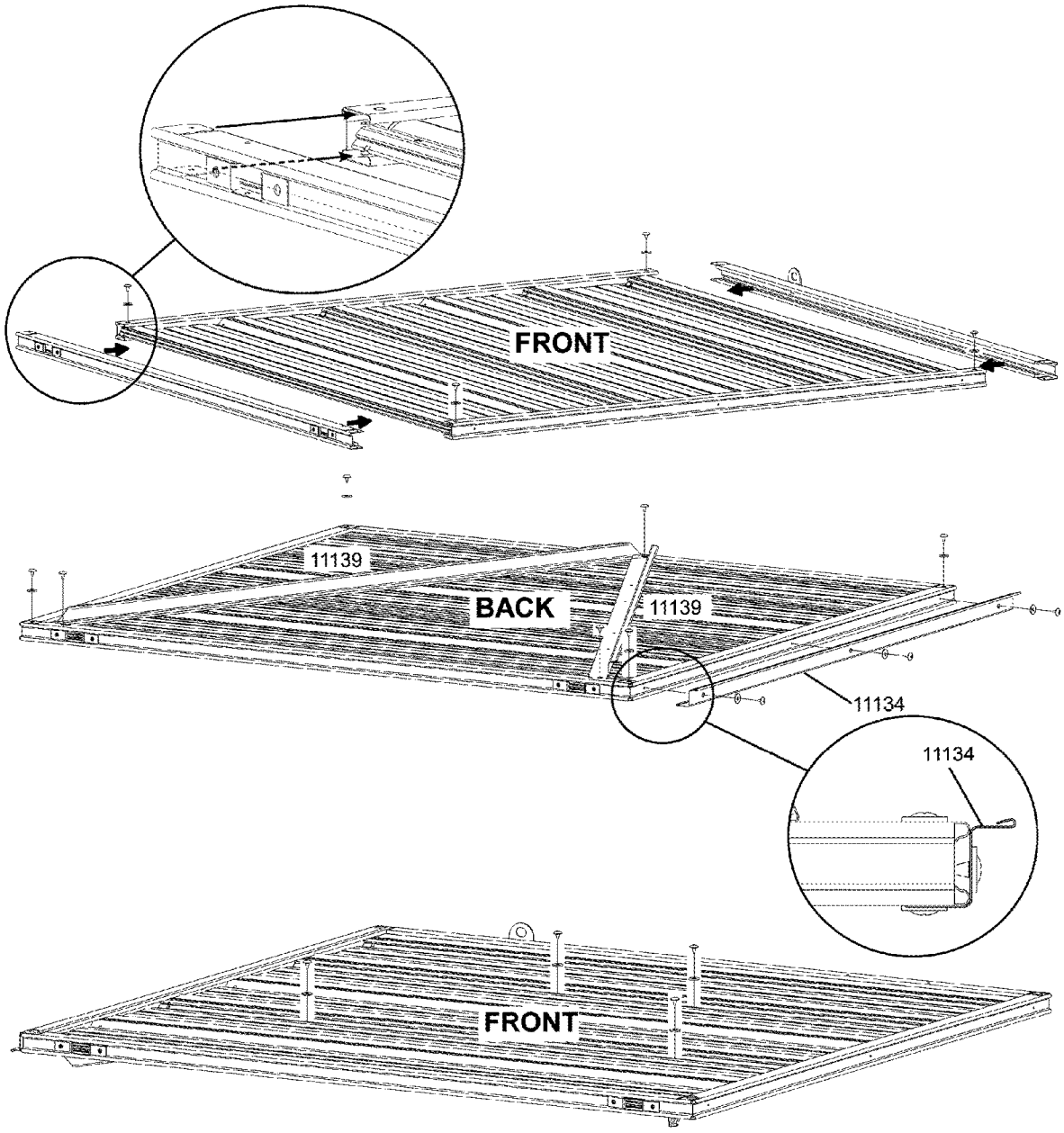
Figure 13A:
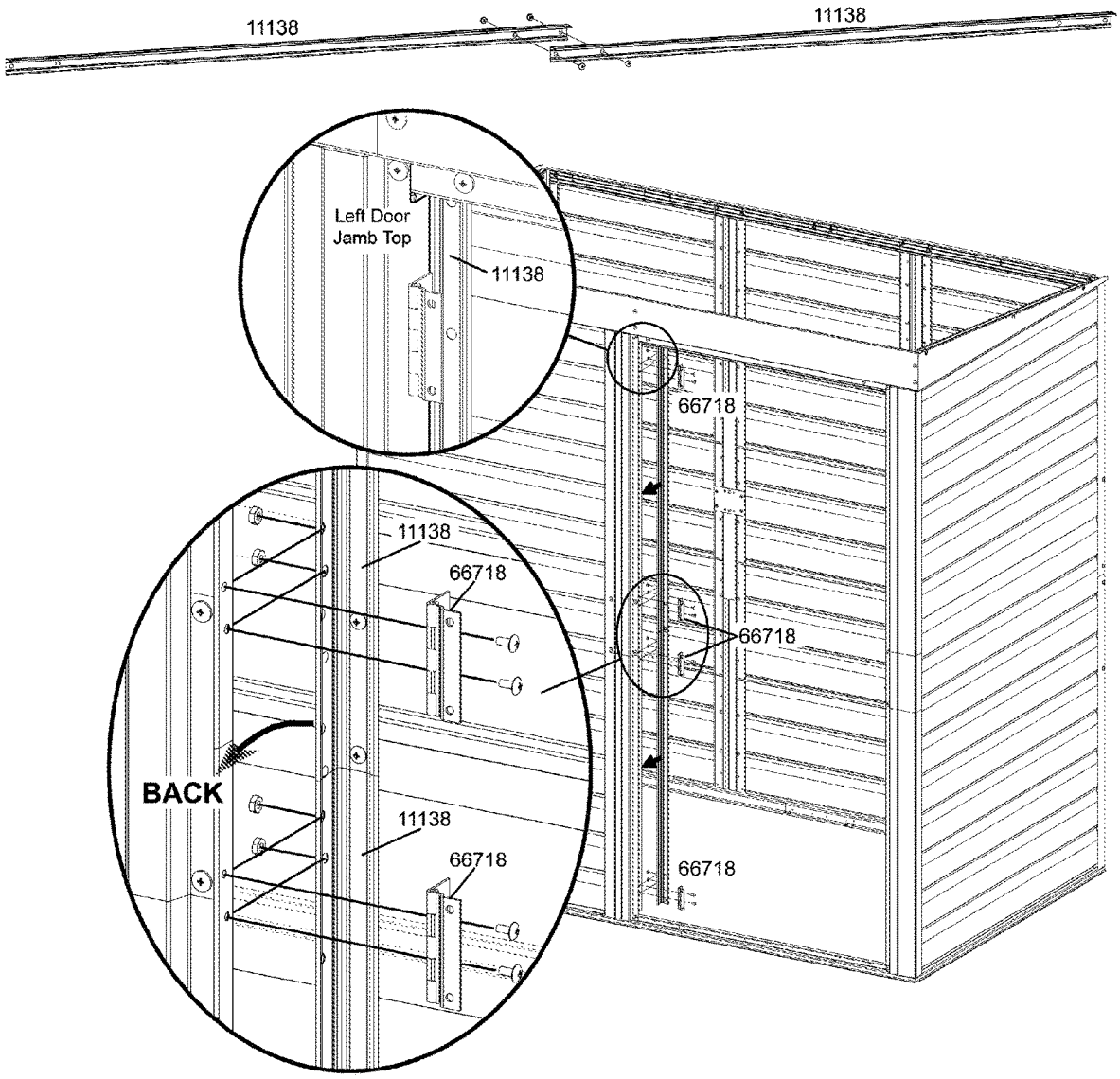
FIGS. 13A, 13B, 13C, and 13D are assembly views of certain components and certain assembly steps in connection with the roof and door trim for one or more of the preferred shed constructions of the present invention.
Figure 13B:
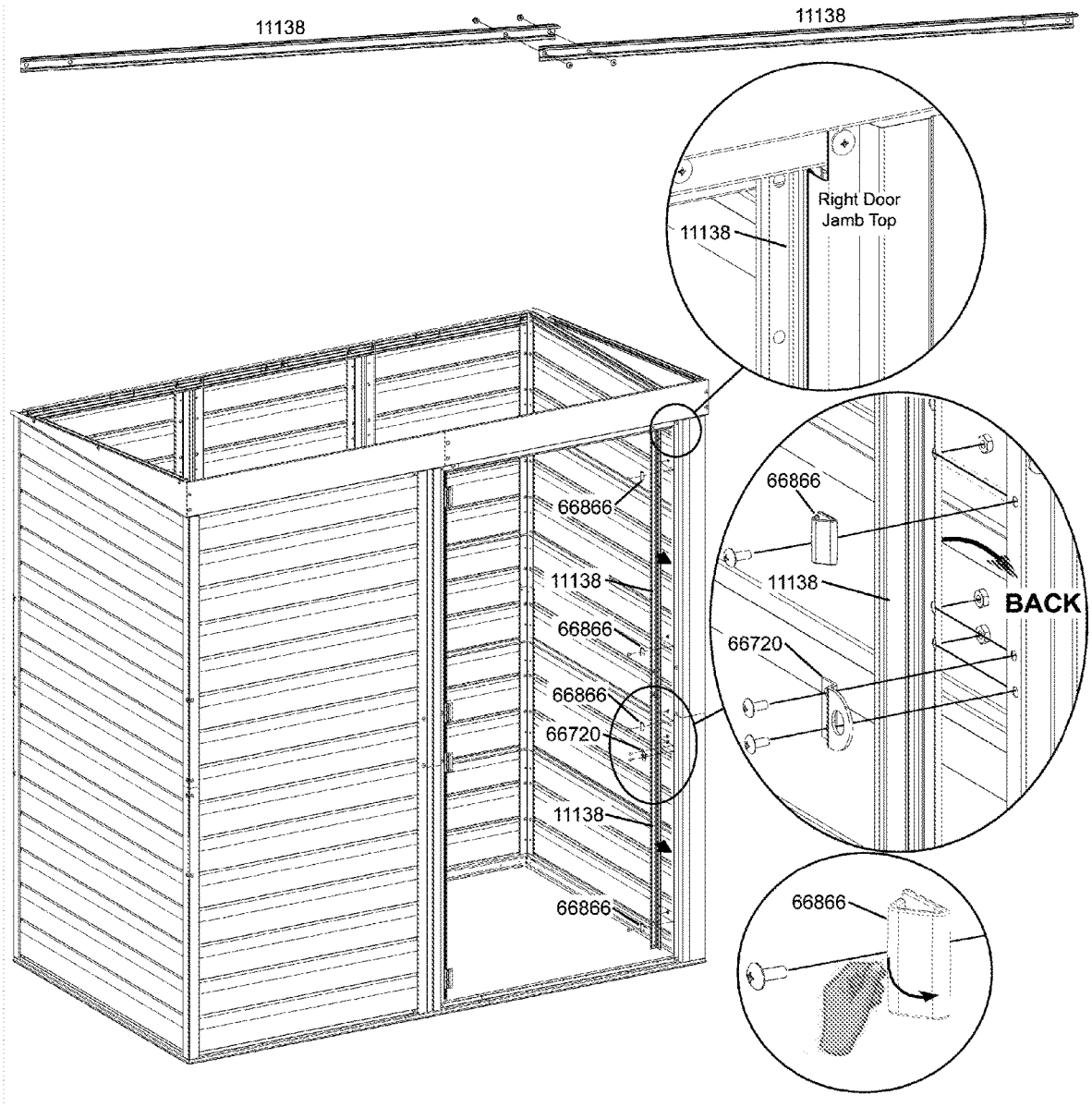
Figure 13C:
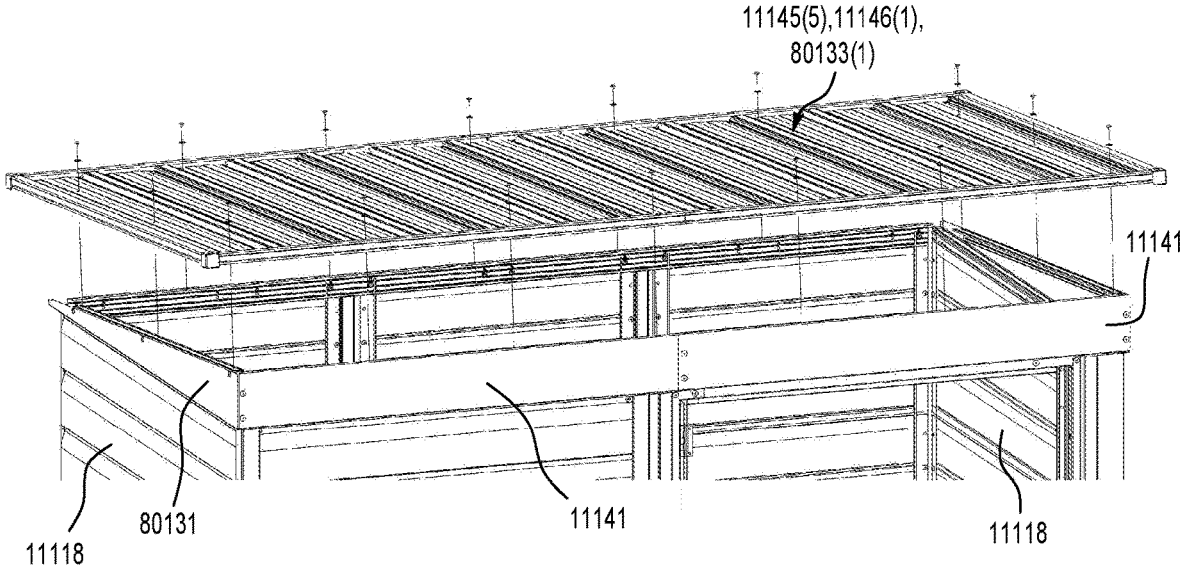
Figure 13C:
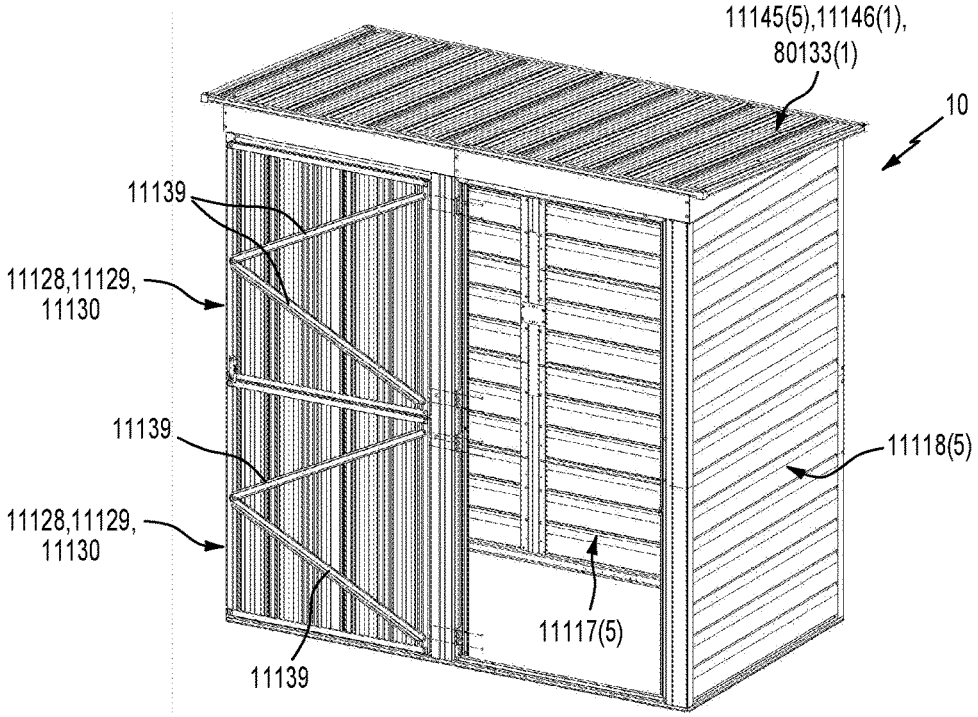
Figure 13D:
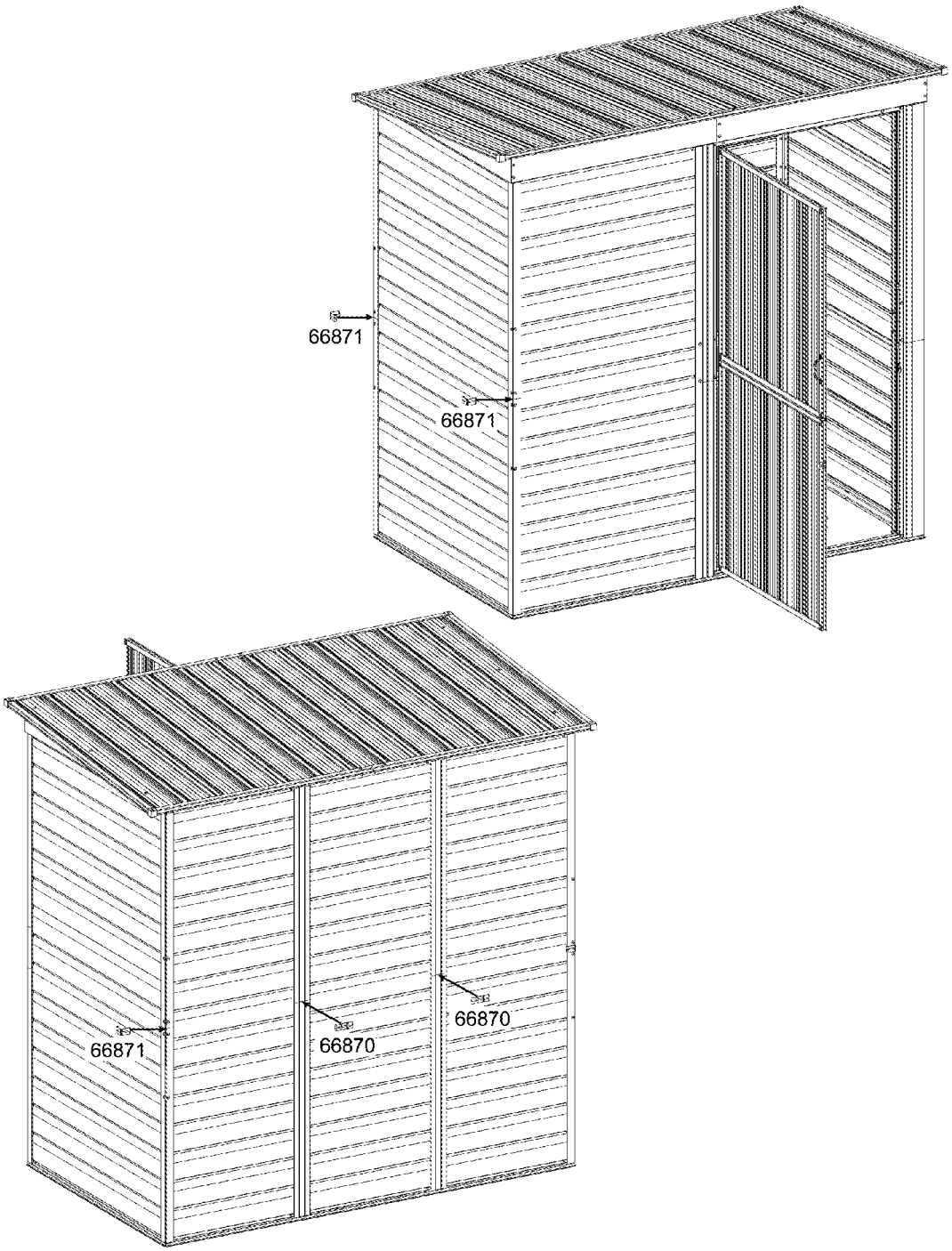

FIGS. 10A, 10B, and 10C illustrate certain assembly steps for the gable assembly, FIGS. 11A, and 11B illustrate certain assembly steps for constructing the roof; FIGS. 12A, 12B, 12C, and 12D illustrate certain assembly steps in constructing the door; and FIGS. 13A, 13B, 13C, and 13D illustrate certain assembly steps in connection with the roof and door trim assembly, all of which are in connection with constructing one or more of the preferred shed constructions disclosed herein.

Once assembled/erected, sheds constructed in accordance with the present invention should be anchored to the ground, into concrete or wood.

As can thus be seen, a kit comprising components of an erectable shed will have such components including at least a plurality of wall panels and side panels (19, 20, 21), a plurality of posts (18) for supporting the wall panels and side panels (19, 20, 21) coupled thereto; a plurality of roof panels (45, 46, 48), coupleable to the plurality of wall panels and/or the plurality of posts, for providing shelter to a space perimetered by the plurality of wall panels and side panels when coupled together and vertically supported by the plurality of posts; at least two (2) door panels (e.g. DP1, DP2) shown in FIGS. 1 and 2, each of which is at least 34 inches in height, for providing access to the space perimetered by the plurality of wall panels and side panels when coupled together and vertically supported by the plurality of posts; and wherein when the erectable shed 10 is erected, the space perimetered by the wall panels and side panels is at least 6 feet long by 40 inches wide and wherein the height of erectable shed is at least 6 feet.

In a preferred embodiment, the kit comprises at least fifteen (15) wall panels, at least ten (10) side panels, at least (six) 6 corner posts, at least four (4) splice posts, and at least four (4) door panels, Preferably, at least the wall panels, side panels, posts and door panels are each comprised of metal.

Preferably, the kit will comprise additional components, i.e. one or more of such additional components being identified in description and quantity as set forth in Table 1. It should also be understood that the figures identify the components of Table 1 by both part numbers and key numbers. Such identification nevertheless should be well understood by one of ordinary skill in the art. In a particularly specific embodiment, the kit comprises all of the components, in description and quantity, as set forth in Table 1 that have references to "key nos." 15-40. In a more specific preferred embodiment, the kit comprise all the parts illustrated in Table 1, including the parts with "key" numbers 1-14.

To be sure, a kit of a preferred embodiment comprises a box, generally indicated in the figures with reference number 100, having dimensions of no greater than 48 inches long (L)×no greater than 20 inches wide (W)×no greater than 10 inches high (H), wherein at least said plurality of wall panels and side panels, said plurality of posts, said plurality of roof panels, and said at least two (2) door panels are provided in said box when the erectable shed is not erected.

Reference is next made to FIGS. 14-19 to illustrate preferred packaging arrangements and configurations to store, transport and/or display the erectable sheds in their pre-assembled and component form. As disclosed above, such packaging, preferably in box form, is such that the erectable sheds of the present invention may be easily and conveniently stacked and/or displayed in stores, and thereafter, purchased and conveniently transported by consumers back to their preferred destination for assembly, e.g. at one's home. That is, prior known shed kits have only been available in large, extremely cumbersome packaging configurations, i.e. not easy and often quite difficult for transport in a passenger vehicle or the like.

Figure 14:
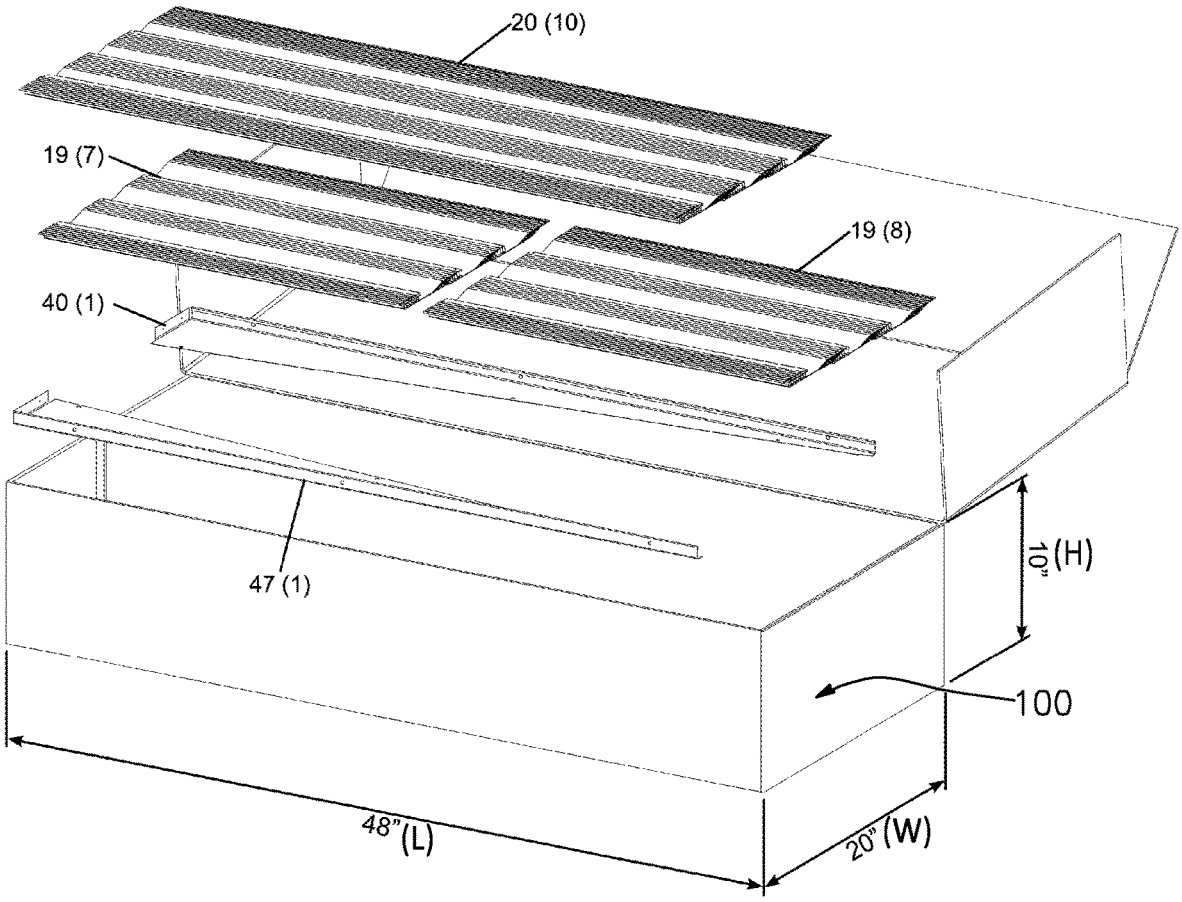
FIGS. 14-19 are a sequence of views illustrating a preferred sequence of steps of packaging box 100 that will include the components of the erectable sheds constructed in accordance with preferred embodiments of the present invention.
Figure 15:
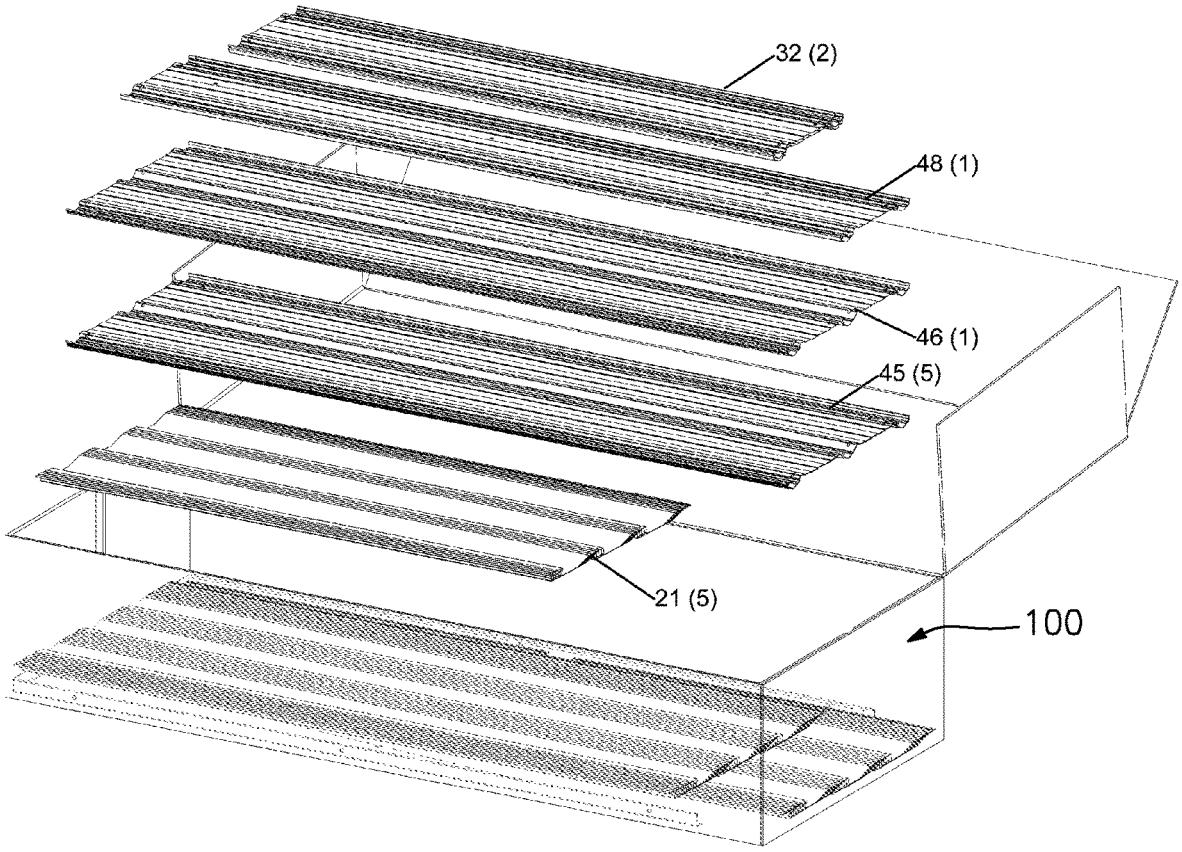
Figure 16:
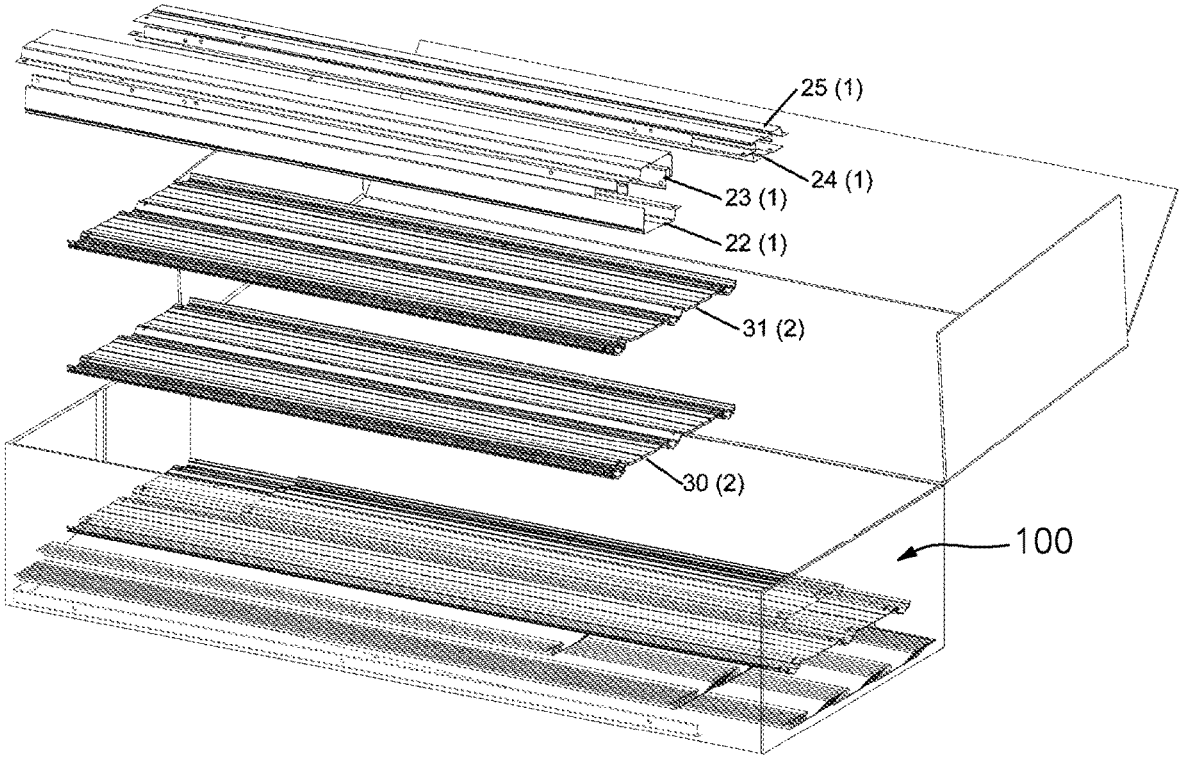
Figure 17:
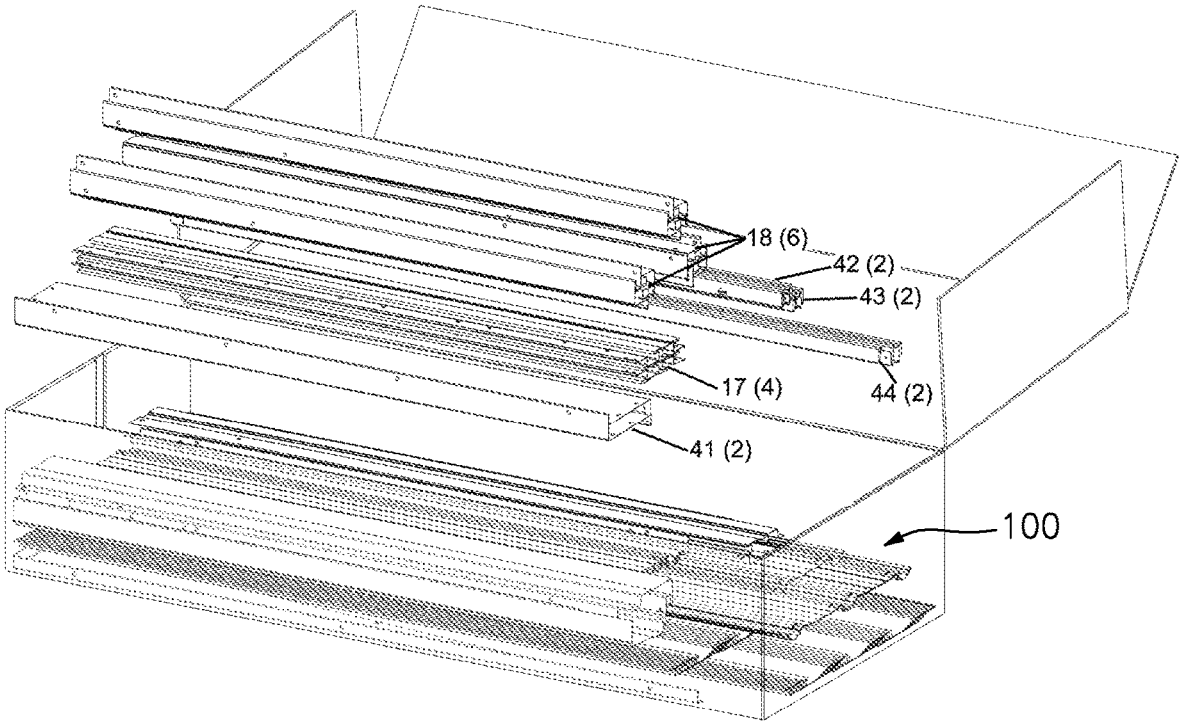
Figure 18:
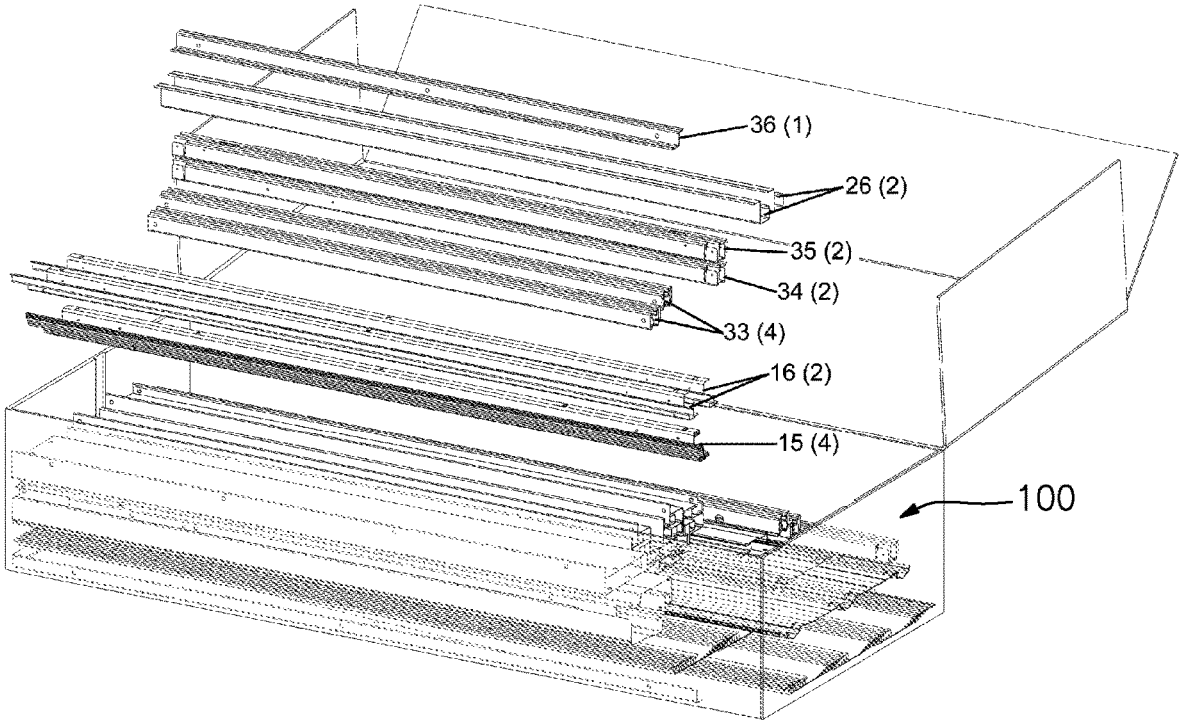
Figure 19:
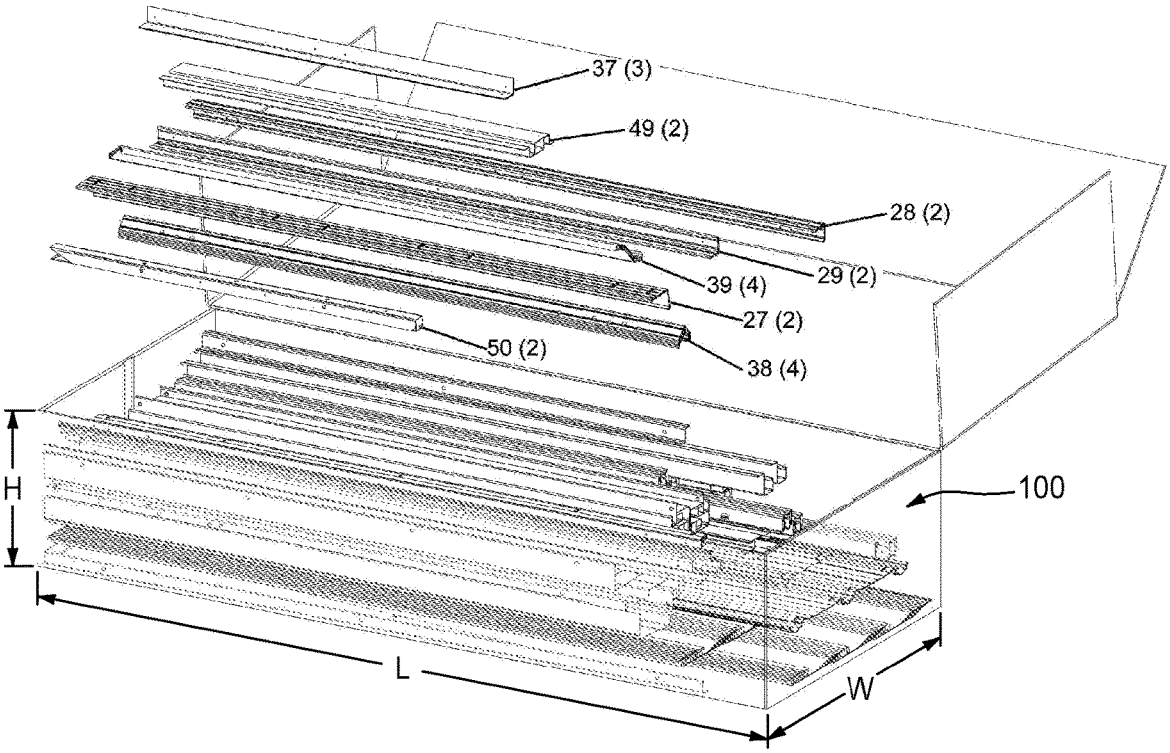
Figure 20:
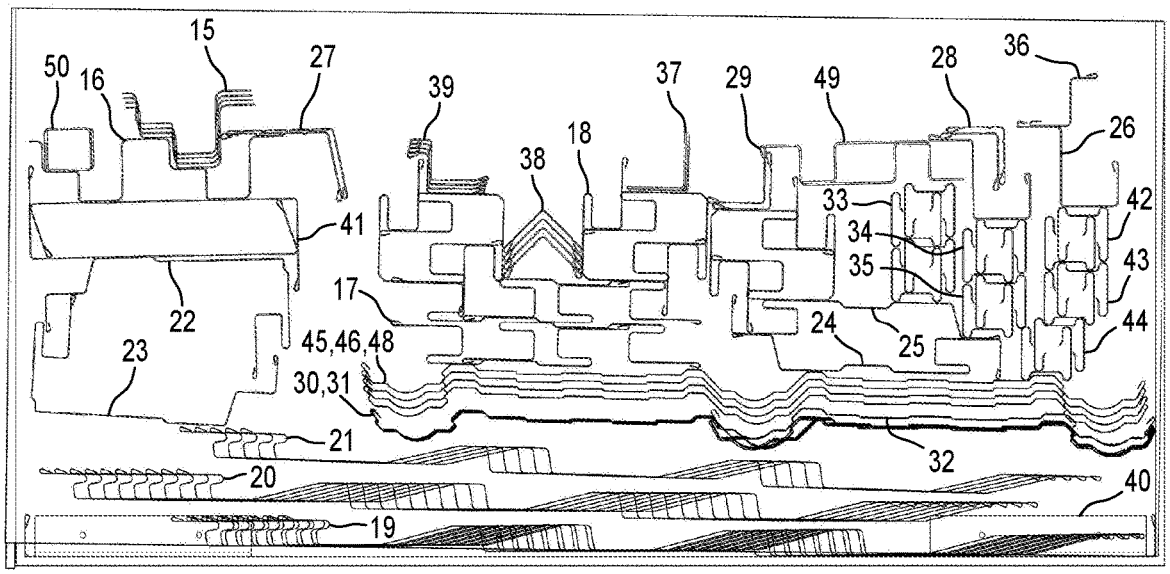
FIG. 20 illustrates a cross-section of the box with all the components with reference numbers 15-50 packaged therein.

Reference is now particularly made to FIGS. 14-19, which illustrate a preferred sequence of steps of packaging box 100 that will include the components of the erectable sheds constructed in accordance with the preferred embodiments of the present invention. Specifically, and for example, FIG. 14 illustrates one of the initial preferred steps in which the right and left gables (40, 47), along with the wall panels (19) and side panels (20), are positioned in box 100. FIG. 15 shows a preferred subsequent step in which the front wall panels (21) are positioned in the box 100 along with the door panels (32) and the roof panels (45, 46, 48). Thereafter, and as illustrated in FIG. 16, the preferred sequence of packing steps includes the inserting and positioning of more of the door panels (30, 31) and the door jamb components (22, 23, 24, 25). Subsequent thereto, the preferred method of packing box 100 with the components of the erectable sheds (10) disclosed herein is as illustrated in FIG. 17 comprises the steps of inserting and positioning the front header (41), the splice posts (17), the corner posts (18), the roof channels (42, 43) and the fascia trim (44). FIG. 18 illustrates the next preferred steps of inserting and positioning components of the floor frame, namely, the front/rear floor frame (15) and the side floor frame (16), the door braces (33, 34, 35), the header (26), and the door astragal (36). And finally, the preferred packing sequence as illustrated in FIG. 19 comprises the steps of packaging the channel splice (50), the door jamb support (38), the door brace (39), the rear and side wall angles (27, 28) as well as the gable angle (29), corner splice angle (37), diagonal door brace (39), and stud splice (49). The quantity of each identified part/component is provided in Table 1. It is also to be understood that a completed and fully packaged box 100 will also contain the needed, bolts, nuts, screws, washer sheets, door handle, hinges, eyelets, corner caps, plastic trim, corner plastic trim, latch spring, U-nuts, door closure clips and/or mounting plates. As can also be seen in FIGS. 14-19, preferably each set of components are layered upon one another for compactness. FIG. 20 is a cross section of box 100 showing all the components with "key" numbers 15-50. In a further preferred embodiment, box 100 has, and will in fact contain, all the parts described in Table 1, including the parts with "key" numbers 1-14.

Based on the foregoing, it can thus be seen that the present invention is also directed to a method of erecting an erectable shed comprising the components of the erectable shed as set forth herein, wherein the method comprises the steps of removing all of the components of the erectable shed from the box (100); and constructing the erectable shed (10) so as to have a space perimetered by the wall panels and side panels of at least 6 feet long by 40 inches wide and wherein the height of the shed is at least 6 feet. In accordance with a particular embodiment, it is preferable to include many additional components of the erectable shed as set forth in Table 1 into box (100) during the packaging and display thereof. In such an embodiment, the invention is directed to a method of erecting an erectable shed comprising many of the components set forth in Table 1, wherein the method comprises the steps of removing all of the included components of the erectable shed from the box (100); and constructing the erectable shed (10) so as to have a space perimetered by the wall panels and side panels of at least 6 feet long by 40 inches wide and wherein the height of the shed is at least 6 feet. Even further preferably, the box (100) will contact all of the components as set forth in Table 1, thus providing a method of erecting an erectable shed 10 comprising all the components of Table 1, comprising the steps of removing all of the components of the erectable shed from the box (100); and constructing the erectable shed (10) so as to have a space perimetered by the wall panels and side panels of at least 6 feet long by 40 inches wide and wherein the height of the shed is at least 6 feet.

In summary, the present invention provides for an arrangement and method of assembling, storing, transporting and/or displaying a shed that is, for example, and not limitation, at least and preferably six (6) feet long and 40 inches wide, with a wall height of at least six (6) feet, in which all of the components thereof can fit in, and be stored, transported and/or displayed in, a package or box that is no greater than 48 inches (L)×no greater than 20 inches (W) by no greater than 10 inches (H) (see FIG. 19). Moreover, and preferably, the objectives and advantages of the present invention are achieved in part by the use of the spliced style of design as disclosed herein.

While the present invention has been described with respect to preferred embodiments, those skilled in the art will readily appreciate that various changes and/or modifications can be made to the invention without departing from the spirit or scope of the invention. It is intended that the terms "couple" or "coupled" or "couplable" should be given their plain and ordinary meaning. In other words, these terms should not be interpreted so strictly as meaning physically joined or attached or (e.g.) direct attachment. That is, as used herein "couple" or "coupled" or "coupleable" should be understood so as not to require (but could of course permit) direct attachment or direct connection, noting that it is intended that such terms include (e.g.) "coupling" or being "coupleable" by indirect connection through one or more intermediate components.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense. The following claims are intended to cover all of the generic and specific features of the invention described herein and all statements of the scope of the invention that as a matter of language might fall therebetween.

What is claimed is:

1. A kit of components for an erectable shed, the kit comprising:

twenty wall panels and ten side panels;

a plurality of supports comprising four splice posts, six corner posts, one right door top jamb, one right door bottom jamb, one left door top jamb and one left door bottom jamb configured for supporting the wall panels and side panels coupled thereto;

seven roof panels, configured to be coupled to at least one of the wall panels and the plurality of supports, for providing shelter to a space perimetered by the wall panels and side panels coupled together and vertically supported by the plurality of supports;

at least two doors formed from a plurality of door panels, each of the doors being at least thirty-four inches in height, for providing access to the space perimetered by the wall panels and side panels coupled together and vertically supported by the plurality of supports; and wherein in an erected configuration, the space perimetered by the wall panels and side panels is at least 6 feet long by 40 inches wide, and a height of the erectable shed is at least 6 feet; and wherein in a storage configuration, the components of the erectable shed are configured to be stored in a box having dimensions of no greater than 48 inches×20 inches×10 inches; and wherein the kit further comprises at least: six floor frames, two headers, two rear wall angles, two side wall angles, two gable angles, four horizontal door braces, four vertical door braces, one door astragal, three corner splice angles, four door jamb supports, four diagonal door braces, one right gable, two front headers, two roof right channels, two roof left channels, two fascia trim, one left gable, two stud splices and two channel splices.

2. The kit as claimed in claim 1, wherein the wall panels, side panels, posts and door panels are each comprised of metal.

3. The kit as claimed in claim 1, further comprising at least sixty-three bolts, at least sixty-three nuts, at least two hundred sixty-six screws, three washer sheets, one door handle, four hinges, two padlock eyelets, four corner caps, two plastic trim, three plastic corner trim, one latch spring, eight u-nuts, four door closure clips and two mounting plates.

4. A kit of components for an erectable shed, wherein the kit comprises:

twenty wall panels and ten side panels;

a plurality of supports comprising four splice posts, six corner posts, one right door top jamb, one right door bottom jamb, one left door top jamb and one left door bottom jamb configured for supporting the wall panels and side panels coupled thereto;

seven roof panels, configured to be coupled to at least one of the wall panels and the plurality of supports, for providing shelter to a space perimetered by the wall panels and side panels coupled together and vertically supported by the plurality of supports;

at least two doors formed from a plurality of door panels, each of the doors being at least thirty-four inches in height, for providing access to the space perimetered by the wall panels and side panels coupled together and vertically supported by the plurality of supports; and a box having dimensions of no greater than 48 inches×20 inches×10 inches, wherein said wall panels and side panels, said plurality of supports, said roof panels, and said door panels are provided in said box in a storage configuration of the erectable shed; and wherein in an erected configuration, the space perimetered by the wall panels and side panels is at least 6 feet long by 40 inches wide, and a height of the shed is at least 6 feet; and wherein the kit further comprises at least: six floor frames, two headers, two rear wall angles, two side wall angles, two gable angles, four horizontal door braces, four vertical door braces, one door astragal, three corner splice angles, four door jamb supports, four diagonal door braces, one right gable, two front headers, two roof right channels, two roof left channels, two fascia trim, one left gable, two stud splices and two channel splices.

5. The kit as claimed in claim 4, further comprising at least sixty-three bolts, at least sixty-three nuts, at least two hundred sixty-six screws, three washer sheets, one door handle, four hinges, two padlock eyelets, four corner caps, two plastic trim, three plastic corner trim, one latch spring, eight u-nuts, four door closure clips and two mounting plates.

6. A method of erecting an erectable shed utilizing the kit as claimed in claim 1, comprising the steps of:

removing all of the components of the erectable shed from the box; and constructing the erectable shed so as to have the space perimetered by the wall panels and side panels of at least 6 feet long by 40 inches wide and wherein the height of the erected shed is at least 6 feet.

7. A method of erecting an erectable shed utilizing the kit as claimed in claim 3, comprising the steps of:

removing all of the components of the erectable shed from the box; and constructing the erectable shed so as to have the space perimetered by the wall panels and side panels of at least 6 feet long by 40 inches wide and wherein the height of the erected shed is at least 6 feet.

8. A method of erecting an erectable shed utilizing the kit as claimed in claim 4, comprising the steps of:

removing all of the components of the erectable shed from the box; and constructing the erectable shed so as to have the space perimetered by the wall panels and side panels of at least 6 feet long by 40 inches wide and wherein the height of the erected shed is at least 6 feet.

* * * * *